US007088349B2

(12) United States Patent
Iisaka

(10) Patent No.: US 7,088,349 B2
(45) Date of Patent: Aug. 8, 2006

(54) DRIVE METHOD OF AN ELECTRO OPTICAL DEVICE, A DRIVE CIRCUIT AND AN ELECTRO OPTICAL DEVICE AND AN ELECTRONIC APPARATUS

(75) Inventor: Hidehito Iisaka, Shiojiri (JP)

(73) Assignee: Seiko Epson Corp., Tokyo (JP)

( * ) Notice: Subject to any disclaimer, the term of this patent is extended or adjusted under 35 U.S.C. 154(b) by 398 days.

(21) Appl. No.: 10/299,865

(22) Filed: Nov. 20, 2002

(65) Prior Publication Data

US 2003/0142055 A1 Jul. 31, 2003

(30) Foreign Application Priority Data

Dec. 14, 2001 (JP) ..... 2001-381580

(51) Int. Cl.
*G09G 3/36* (2006.01)

(52) U.S. Cl. ..... 345/204; 345/55; 345/60; 345/63; 345/68; 345/89; 345/100; 345/103; 345/210; 345/690; 345/691; 315/169.1; 349/77; 349/83

(58) Field of Classification Search ..... 345/55, 345/60, 63, 68, 89, 100, 103, 204, 210, 690, 345/691; 315/169.1; 349/77, 83
See application file for complete search history.

(56) References Cited

U.S. PATENT DOCUMENTS 5,581,406 A 12/1996 Kobayashi et al.
5,642,133 A * 6/1997 Scheffer et al. ..... 345/690
5,757,343 A * 5/1998 Nagakubo ..... 345/63
6,014,258 A * 1/2000 Naka et al. ..... 359/618
6,414,658 B1 * 7/2002 Tokunaga ..... 345/63
6,429,833 B1 * 8/2002 Ryeom et al. ..... 345/63
6,549,180 B1 * 4/2003 Yoo et al. ..... 345/60
2001/0045923 A1 * 11/2001 Otobe et al. ..... 345/63

* cited by examiner

*Primary Examiner*—Bipin Shalwala
*Assistant Examiner*—Vincent E. Kovalick
(74) *Attorney, Agent, or Firm*—Oliff & Berridge, PLC

(57) ABSTRACT

A method of sub-field drive can display with a mode of placing emphasis on responsiveness and display with a mode of placing emphasis on gray-scale reproductiveness.

A field is divided into plural sub-fields on a time axis, and each of such sub-fields is a control unit of driving a pixel. A code storing ROM stores a code that controls sub-fields to collecting on-voltage intensively in a former part of a field based on display data. Another code storing ROM stores a code that controls sub-fields to increase levels of gray scale based on display data. A data encoder determines whether each pixel of display data is an edge part of a moving image or not, selects a code that enables superior display in responsiveness at the edge part of a moving and selects a code that enables superior display in gray scale reproductiveness in other parts from the ROMs. Therefore, superior sight recognition of a moving image can be attained and reproduction of multi-levels gray scale in a still image can be available simultaneously.

18 Claims, 17 Drawing Sheets

1 FIELD PERIOD
OPTICAL RESPONSE

0/16

1/16

2/16

3/16

4/16

5/16
1 2 3 4 5 6 7 8 9 10 11 12 13 14 15 16

1 FIELD PERIOD

12/16

13/16

14/16

15/16

16/16

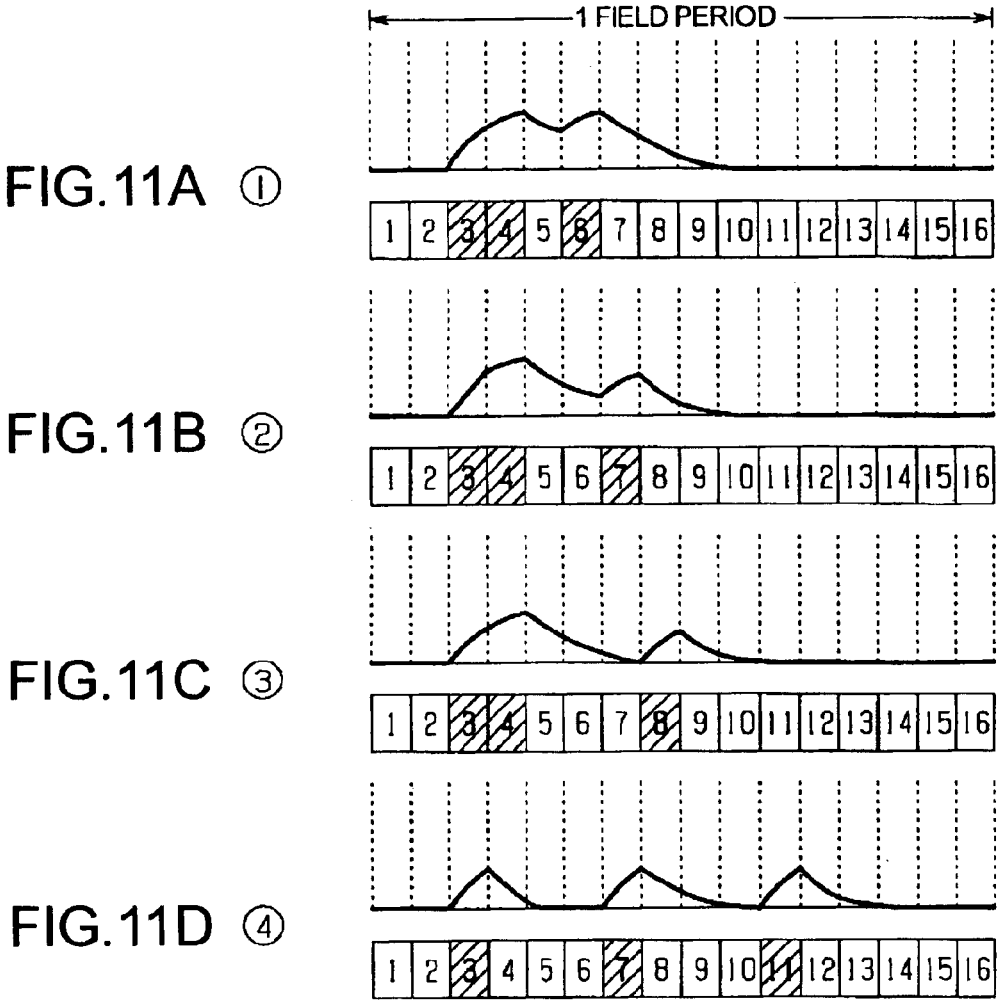
1 FIELD PERIOD
FIG.11A ①
1 2 3 4 5 6 7 8 9 10 11 12 13 14 15 16
FIG.11B ②
1 2 3 4 5 6 7 8 9 10 11 12 13 14 15 16
FIG.11C ③
1 2 3 4 5 6 7 8 9 10 11 12 13 14 15 16
FIG.11D ④
1 2 3 4 5 6 7 8 9 10 11 12 13 14 15 16

FIG.12A $\frac{10}{16}$
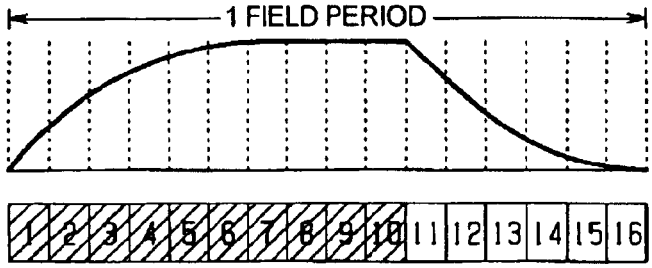
FIG.12B ⑥
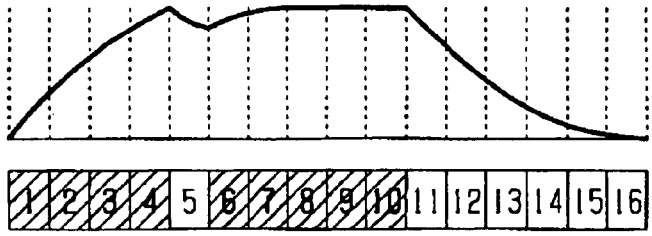
FIG.12C ⑦
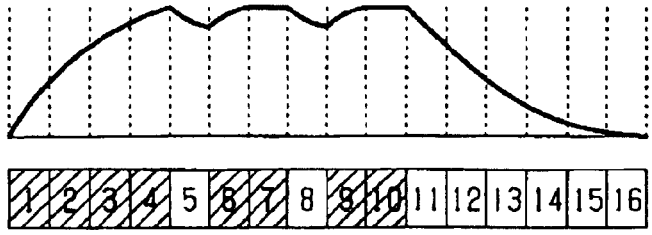

DRIVE METHOD OF AN ELECTRO OPTICAL DEVICE, A DRIVE CIRCUIT AND AN ELECTRO OPTICAL DEVICE AND AN ELECTRONIC APPARATUS

BACKGROUND OF THE INVENTION

1. Field of Invention

The present invention relates to a method of driving an electro optical device where gray-scale display is controlled by a sub-field drive method, a drive circuit and an electronic apparatus thereof.

2. Description of Related Art

In the related art, an electro-optical device, such as a liquid crystal display using liquid crystal as electro-optical material, for example, can be unitized for a display portion of various kinds of information apparatus, liquid crystal TV, etc., as a display device that can replace a cathode ray tube (CRT).

Such a liquid crystal display device, for example, includes pixel electrodes arranged in a matrix, an clement substrate including switching elements, such as TFT's (Thin Film Transistors), connected to these pixel electrodes, an opposite substrate including an electrode opposite to each of the pixel electrodes and liquid crystal as electro-optical material filled between these substrates.

A display mode of such a liquid crystal display device includes a normally white mode where a white image is displayed without voltage, and a normally black mode where a black image is displayed without voltage.

Next, an operation of displaying gray scale of an image with a liquid crystal display device is explained.

A switching element is turned on by a scanning signal supplied via a scanning line. An image signal in response to gray scale is applied to a pixel electrode via a data line under the state where the switching element is in an on-state by applying the scanning signal. Then an amount of electric charge in response to voltage of the image signal is accumulated between the pixel electrode and an opposite electrode. This state of electric charge accumulation can be maintained in each electrode by capacity nature of a liquid crystal layer and storage capacitance after accumulating electric charge, even if the switching element is in an off state by removing the scanning signal.

Hence, the orientation state of liquid crystal can be changed every pixel by driving each of the switching elements and controlling the amount of accumulated electric charge in response to gray scale so that transmittance ratio of light is changed and brightness can be changed every pixel. Thus, it is possible to realize a gray-scale display.

In consideration of capacitive nature of the liquid crystal layer and of storage capacitance, it is preferable that electric charge be applied to the liquid crystal layer of each pixel only during a part of a period. Therefore, when plural pixels arranged in a matrix are driven, the scanning signal is applied to pixels connected to each other on the same scanning line simultaneously and the image signal is applied to each pixel via a data line and the scanning line to supply an image signal is switched sequentially. Namely, in the liquid crystal display device, it is possible to attain time-sharing multiplex drive when the scanning line and the data line are shared commonly for plural pixels.

However, the image signal applied to the data line is voltage in response to gray-scale, namely analog signal. Hence, an overall apparatus is highly expensive since an analog circuit or an operational amplifier is necessary for a peripheral circuitry of an electro-optical device. In addition, non-uniformity of display quality occurs due to characteristics of the analog circuit and operational amplifier and/or irregularity of wiring resistance, so that it is difficult to maintain high quality displaying. These problems become especially serious in the case of displaying a fine and accurate image.

SUMMARY OF THE INVENTION

In order to address or overcome the above-mentioned and/or other problems, a sub-field driving system to drive a pixel with a digital approach can be used for an electro optical device, such as a liquid crystal display. In the sub-field driving system, one field is divided into plural sub-fields on a time axis and on-state voltage, or off-state voltage is applied to every pixel in response to gray scale. Further, in the sub-field driving system, the level of voltage applied to liquid crystal is not changed, and-voltage applied to liquid crystal is changed by varying time to apply voltage pulses to liquid crystal instead, so that the transmittance ratio of the liquid crystal panel is controlled thereby. Hence, the levels of voltage to drive the liquid crystal are only binary digits of on-level and off-level.

It is necessary to enhance the response characteristic of liquid crystal in order to enhance reproductiveness for a moving image when such image is displayed in a liquid crystal display as an electro optical device. However, the response time of liquid crystal is relatively slow in comparison with display device, such as plasma display. Hence, a problem exists that sight recognition for a moving image is low.

The present invention provides a method of driving an electro optical device, a driving circuit, an electro optical device and an electronic apparatus, where reproductiveness for a moving image is enhanced and multi-levels of gray scale can be displayed simultaneously by adopting a method where a mode to place emphasis on responsiveness (sight recognition for a moving image) can be switched with a mode to place emphasis on gray-scale reproductiveness.

A drive circuit for an electro optical device of the present invention includes: a display portion having pixels arranged in a matrix and electro optical material of which an optical transmittance ratio is changed by applying voltage, supplies on-voltage to make the transmittance ratio saturated, or off-voltage to make the transmittance ratio non-transmissive to the display portion and implementing sub-field drive to realize a gray scale in response to the ratio of an optical transmissive state to a non-transmissive state of the electro optical material per unit time and time ratio. The drive circuit includes: a data conversion device to place emphasis on responsiveness, driving each of the pixels with each sub-field as a control unit, that is formed by dividing a field into plural portions on a time axis, and designating a sub-field of applying the off-voltage and a sub-field of applying the on-voltage in response to display data; and a data conversion device to place emphasis on gray-scale reproductiveness, driving each of the pixels with the sub-field as a control unit and designating a sub-field of applying the off-voltage and a sub-field of applying the on-voltage in response to the display data so that levels of gray scale are larger than that of the data conversion device to place emphasis on responsiveness.

According to such a structure, it is possible that the transmittance ratio of electro optical material forming each pixel is changed by applying voltage. A drive device drives the pixel with a sub-field, as a control unit, that is formed by dividing a field into plural portions on a time axis and by applying on-voltage to make the transmittance ratio saturated, or off-voltage to make it be a non-transmissive state to electro optical material. The data conversion device to place emphasis on responsiveness, implements gray scale reproductiveness by determining a sub-field of applying on-voltage and a sub-field of applying off-voltage based on display data via a method of enhancing responsive sight recognition. On the other hand, the data conversion device to place emphasis on gray-scale reproductiveness, designates a sub-field of applying on-voltage and a sub-field of applying off-voltage based on display data by a method where levels of gray scale are larger than that of the data conversion device to place emphasis on responsiveness. Hence, both sub-field drive to place emphasis on responsiveness and sub-field drive to place emphasis on gray-scale reproductiveness can be available.

In addition, the data conversion device to place emphasis on gray-scale reproductiveness sets time of the sub-field to be shorter than saturation-response time until the transmittance ratio of the electro optical material is saturated after the on-voltage is applied.

According to such a structure, the transmittance ratio of the electro optical material can be changed more finely than the number of sub-fields within one field, since the saturation response time of the electro optical material is longer than a period of one sub-field. Hence, it is possible that levels of gray-scale, of which displaying is available, are increased remarkably compared with numbers of sub-fields within one field.

In addition, the data conversion device to place emphasis on gray-scale reproductiveness sets time of the sub-field to be shorter than non-transmissive response time, when the transmittance ratio of the electro optical material is transferred from a saturated state to a non-transmissive state.

According to this structure, the transmittance ratio of the electro optical material can be changed more finely than the number of sub-fields within one field, since the non-transmissive response time of the electro optical material is longer than one sub-field. Hence, it is possible that levels of gray-scale, of which displaying is available, are increased remarkably compared with numbers of sub-fields within one field.

In addition, the data conversion device to place emphasis on gray-scale reproductiveness applies the on-voltage to the electro optical material during continuous or discontinuous sub-fields, so that the integral value of the transmissive state of the electro optical material during the field period corresponds to display data.

According to such a structure, the on-state voltage is applied to electro optical material in continuous or discontinuous sub-fields, so that the integral value of the transmissive state of the electro optical material during the field period corresponds to display data. Hence, display with gray scale can be available.

In addition, the data conversion device to place emphasis on responsiveness, applies the on-voltage to the electro optical material during the period of the former end part of the sub-field among the field intensively.

According to this structure, responsive characteristic of display can be enhanced, since the electro optical material can be a non-transmissive state easily in the latter end portion of a field period.

In addition, the data conversion device to place emphasis on responsiveness, applies the off-voltage to the electro optical material during the period of the latter end part of the sub-field in the field intensively.

According to this structure, the responsive characteristic of display can be enhanced since the electro optical material can be a non-transmissive state easily in the latter end portion of a field period.

In addition, the data conversion device to place emphasis on responsiveness, applies the on-voltage to the electro optical material during continuous sub-fields, so that the integral value of the transmissive state of the electro optical material during the field period corresponds to display data.

According to such structure, the on-voltage is applied to the electro optical material during continuous or discontinuous sub-fields, so that the integral value of the transmissive state of the electro optical material during the field period corresponds to display data. Hence, display with multi levels of gray scale can be available.

In addition, plural sub-fields within each field are set to have an almost equivalent time width.

According to such a structure, two kinds of the data conversion device can co-exist on the same display and can be applied easily to the sub-field drive of a liquid crystal display device.

In addition, a selective device to select either the data conversion device to place emphasis on responsiveness, or the data conversion device place emphasis on gray-scale reproductiveness, can be provided.

According to this structure, sub-field drive to place emphasis on responsiveness, or the sub-field drive to place emphasis on gray-scale reproductiveness can be selectively implemented by the selective device.

In addition, the selective device selects either the data conversion device to place emphasis on responsiveness, or the data conversion device to place emphasis on gray-scale reproductiveness based on a user's operation.

According to such a structure, a user can select a display having superiority on responsiveness or a display having superiority on gray-scale reproductiveness.

In addition, the selective device selects either the data conversion device to place emphasis on responsiveness, or the data conversion device to place emphasis on gray-scale reproductiveness based on kinds of signals of the display data.

According to such a structure, a display having superiority of responsiveness or a display having superiority of gray-scale reproductiveness can be selected in response to kinds of signals of the display data. Hence, for example, a display having superiority of gray scale is selected for display data from a personal computer, and a display having superiority of responsiveness is selected for display data from a VTR is selected, so that it is possible to realize an image display which is easy to view.

In addition, the selective device selects either the data conversion device to place emphasis on responsiveness, or the data conversion device to place emphasis on gray-scale reproductiveness based on a state whether the display data is a moving image or a still image.

According to such a structure, for example, the data conversion device to place emphasis on responsiveness is selected at the time of a moving image, the data conversion device to place emphasis on gray-scale reproductiveness is selected at the time of a still image. Hence, the sight recognition of a moving image can be enhanced, and a still image can be displayed with sufficient resolution simultaneously.

In addition, the selective device selects either the data conversion device to place emphasis on responsiveness, or the data conversion device to place emphasis on gray-scale reproductiveness by determining whether the display data is a moving image or a still image every pixel.

According to such a structure, either the data conversion device to place emphasis on responsiveness, or the data conversion device to place emphasis on gray-scale reproductiveness can be selected by determining whether the display data is a moving image or a still image every pixel. Hence, detail and fine display control can be provided.

In addition, the selective device selects either the data conversion device to place emphasis on responsiveness, or the data conversion device to place emphasis on gray-scale reproductiveness by determining whether the display data is a moving image or a still image every pixel in response to change of gray scale of the display data.

According to such a structure, change of gray scale of the display data is detected every pixel so that the display data is determined as a moving image or a still image every pixel and detail and fine display control can be provided thereby.

In addition, the selective device determines the different levels of gray-scale of the display data before and after one field every pixel and selects either the data conversion device to place emphasis on responsiveness when the different levels of gray scale are smaller or equal to the predetermined reference value, or the data conversion device to place emphasis on gray-scale reproductiveness when the different levels of the gray scale are over the predetermined reference value.

According to such a structure, an edge part of an moving image is determined before and after one field and detail and fine display control can be available every pixel.

A method of driving an electro optical device of the present invention that includes: a display portion having pixels arranged in a matrix and electro optical material of which optical transmittance ratio is changed by applying voltage, supplies on-voltage to make the transmittance ratio saturated, or off-voltage to make the transmittance ratio a non-transmissive state to the display portion, implements sub-field drive to realize a gray scale in response to the ratio of an optical transmissive state to a non-transmissive state of the electro optical material per unit time and time ratio. The method includes: driving the pixel with a sub-field as a control unit that is formed by dividing a field into a plural portions on a time axis; and selecting either a data conversion process to place emphasis on responsiveness, designating the sub-field of applying the off-voltage and the sub-field of applying the on-voltage in response to the display data, or a data conversion process to place emphasis on gray-scale reproductiveness, designating the sub-field of applying the off-voltage and the sub-field of applying the on-voltage in response to the display data so as to make the levels of gray scale be larger than that of the data conversion process to place emphasis on responsiveness.

According to such a method, the light transmittance ratio of electro optical material constituting each pixel is changeable by applying voltage. In the sub-field drive, each of sub-fields that are formed by dividing a field into plural portions on a time axis is a control unit. Each pixel is driven by applying the on-state voltage to make the transmittance ratio saturated, or the off-state voltage to make it be a non-transmissive state. Gray-scale display is completed by determining whether the sub-field is to apply on-voltage or off-voltage based on display data. In this determination, it is available that a data conversion process to place emphasis on gray-scale reproductiveness, designates the sub-field with applying the off-voltage and the sub-field with applying the on-voltage in response to the display data so as to make the levels of gray scale larger than that of the data conversion process to place emphasis on responsiveness. Hence, display in response to an actual image can be provided.

In addition, an electro optical device of the present invention is provided which includes the above mentioned drive circuit.

According to such a structure, display having superiority of responsiveness and display having superiority of gray scale can be implemented in the sub-field drive so that appropriate display in response to an image is available.

The electronic apparatus of the present invention is provided with the above-mentioned electro optical device.

According to such a structure, superiority of sight recognition of a moving image can be attained and multi-levels of gray scale display can be provided simultaneously.

BRIEF DESCRIPTION OF THE DRAWINGS

FIGS. 11A–11D are schematics to explain a code of a mode for emphasis on gray scale reproductiveness;

FIGS. 12A–12C are schematics to explain a code of a mode for emphasis on sight recognition of a moving image and a mode for emphasis on gray scale reproductiveness;

DETAILED DESCRIPTION OF PREFERRED EMBODIMENTS

Figure 1:
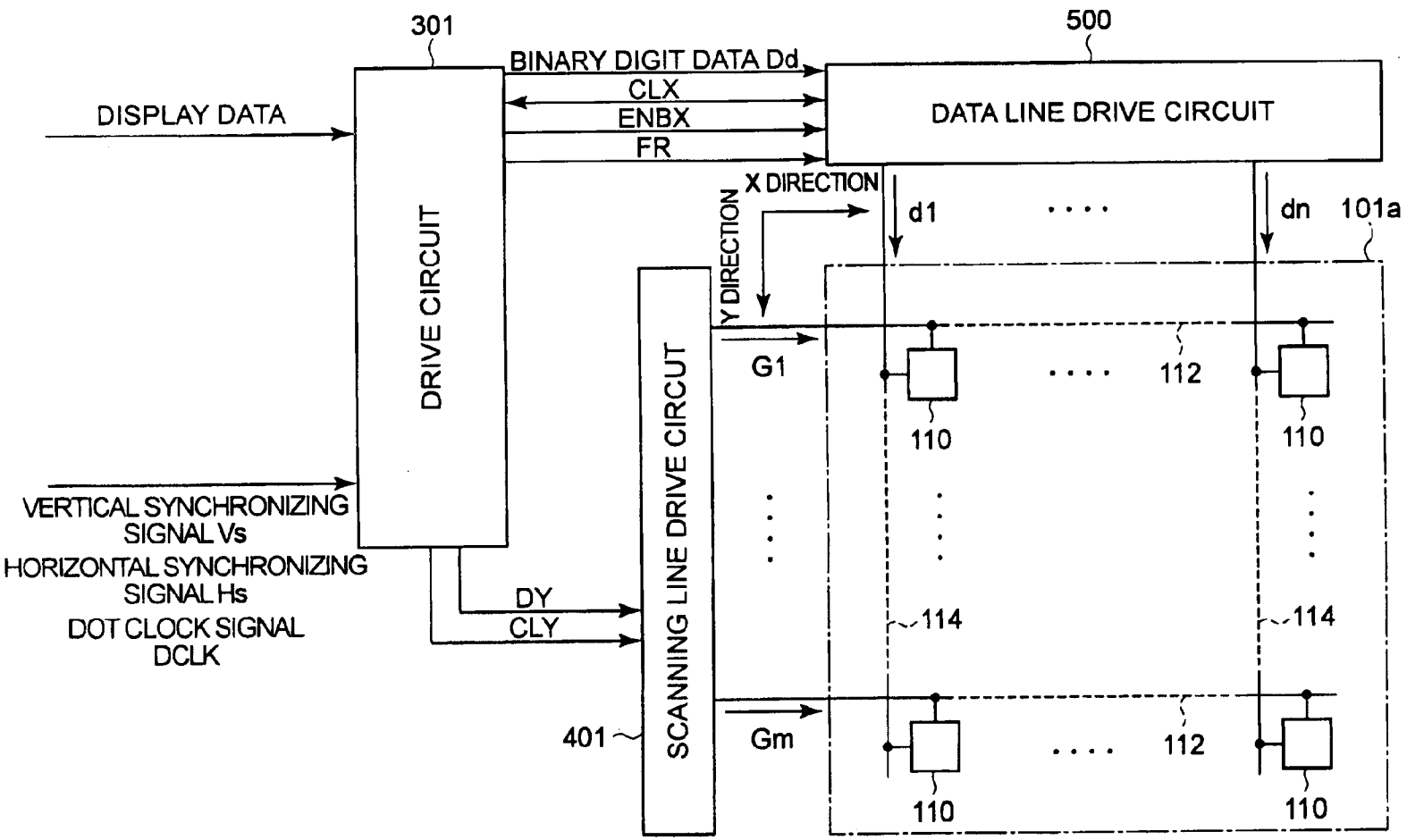
FIG. 1 is a schematic that shows an electro optical device related to a first exemplary embodiment of the present invention.

An exemplary embodiment of the present invention is hereinafter explained in detail with reference to drawings. FIG. 1 is a schematic showing an electro-optical device related to a first exemplary embodiment of the present invention.

An electro-optical device of the present exemplary embodiment is a liquid crystal device, in which liquid crystal is used as electro-optical material, for example. The device includes a structure where an element substrate and an opposite substrate are affixed together, keeping a specific spacing as described hereinafter, and liquid crystal as electro-optical material is sandwiched within this spacing. A display mode of the electro-optical device is normally black, namely a white image is displayed when voltage is applied to a pixel and a black image is displayed when voltage is not applied.

According to the present exemplary embodiment, a sub-field drive method is adopted as a method of driving liquid crystal, where one field is divided into plural sub-fields on a time axis. This sub-field is defined as a control unit and liquid crystal is driven every sub-field period.

In the case of obtaining medium brightness by analog drive, liquid crystal is driven with voltage which is less than or equal to drive voltage for the transmittance ratio to be saturated (hereinafter "liquid crystal saturation-voltage"). Therefore, the light transmittance ratio of liquid crystal is generally proportional to drive voltage and an image display, of which brightness is in response to driving voltage, is obtained.

On the other hand, in the sub-field drive, drive voltage, which is equal to or greater than liquid crystal saturation-voltage (hereinafter "on-state voltage") is applied to the liquid crystal and the light transmittance ratio of liquid crystal is saturated. Then, an image can be obtained, of which brightness is proportional to the ratio of time of applying on-voltage to time of applying voltage (hereinafter "off-state voltage"), namely roughly proportional to time of applying drive voltage per relatively short-unit time (one field period, for example).

Namely, a pulse signal having a pulse width corresponding to one sub-field period Ts (written data for a pixel) is used as a driving signal to drive liquid crystal. In addition, a pulse signal is a signal having binary digit of 1 or 0. For example, if one field is equally divided into 255 sub-fields and the brightness displayed is brightness of N divided by 256 levels of gray scale, pulse signal is controlled to be outputted during time for N sub-fields (Ts×N) and voltage is not applied during the rest (255−N) of sub-fields within one field. Thus, brightness of N divided by 256 levels of gray scale can be obtained.

Next, control of the sub-field drive in this exemplary embodiment is explained.

The transmittance ratio of liquid crystal is changed by applying voltage and transferring its orientation state. In this case, liquid crystal has the characteristic that its response speed between a non-transmissive state and a saturated state of the light transmittance ratio is faster in proportion to the size of electric field applied to a liquid crystal layer at uniform temperature.

Hence, according to the present exemplary embodiment, in order to enhance the response speed of liquid crystal, when a non-transmissive state is transferred to a saturated state of the light transmittance ratio by applying voltage to liquid crystal, high voltage is applied as earliest as possible. On the other hand, when a saturated state of the light transmittance ratio is transferred to a non-transmissive state by applying voltage to liquid crystal, electric field is removed from a liquid crystal layer as early as possible.

Namely, according to the present exemplary embodiment, when responsiveness (sight recognition for a moving image) is considered, on-state voltage is controlled to be outputted continuously only during the period of numbers of sub-fields corresponding to brightness from the beginning of a field. Then, electric field is controlled to not be applied to a liquid crystal layer substantially at the end of a field as much as it can by not applying voltage at the latter half of a field.

Further, sub-field drive is also adapted to a plasma display. In a plasma display and so on, time of writing image data into pixels (scanning time) is necessary every sub-field period. If a sub-field period is narrowed, and the number of sub-fields within one field is increased, the number of times to write image data to pixels within one field is increased so that a displayed image becomes darkened due to short luminescence-time because of this writing. Thus, in a plasma display, overall length of sub-field periods within one field (time width) is changed so that time weighting sub-field drive where each sub-field is weighted is implemented.

On the other hand, in a liquid crystal device, it is possible that luminescence-time is not shortened, even if the number of sub-fields in one field is increased. In addition, the larger the number of sub-fields within one field is, the larger the number of levels of gray scale of which display can be available. Therefore, when gray scale reproduction is considered in a liquid crystal device, it is preferable that the numbers of sub-fields are increased within one field. However, such numbers of sub-fields within one field are restrained by device constraint on speedup.

Hence, saturation-response time of liquid crystal (time to obtain the maximum light transmittance ratio from the time of applying saturation-voltage of liquid crystal) is 2 to 5 mil-seconds if it is used for a projector, for example. This is longer than the time width of a sub-field period that can be realized in a constrained device. Thus, the number of levels of gray scale of which display can be available is increased without increasing numbers of sub-fields within one field.

Next, control of gray scale display regarding the present exemplary embodiment is explained referring to FIGS. 3A–3D. FIGS. 3A–3D shows the change of the optical response of liquid crystal (the light transmittance ratio) of each sub-field period within one field, where a horizontal axis is time and a vertical axis is the light transmittance ratio. An area with oblique lines in FIGS. 3A–3D show a sub-field period of applying on-voltage to liquid crystal of each pixel, and a plain area without oblique lines shows the sub-field period of applying off-voltage.

In case of using electro-optical material having fast response characteristic, such as plasma display, brightness of the pixel is determined by the time ratio of a sub-field period of applying on-voltage (driving voltage for illumination) to electro-optical material to a sub-field period of applying off-voltage (driving voltage for non-illumination). The former sub-field period is referred to as sub-field period for on-state, and the latter sub-field period is referred to as sub-field period for off-state. On the other hand, when saturation-response time is longer than the time width of sub-field period, such as liquid crystal, brightness of a pixel is actually proportional to integral value of the transmittance ratio.

FIGS. 3A–3D show the example where one field is divided into six sub-fields Sf1 . . . Sf6 on a time axis. Namely, in FIG. 3, it is the example that a pixel is driven every sub-field period obtained by dividing one field into 6 equal parts.

Gray scale is displayed by applying voltage to each pixel to make each pixel to be in on state (the state of saturating transmittance ratio) or to be in off state (the state of the light transmittance ratio being 0) in each of the sub-field periods from Sf1 to Sf6 based on data to display brightness (hereinafter "gray scale data").

Applied voltage (drive voltage) to the pixel is saturated instantaneously. But, the response of the transmittance ratio of liquid crystal is slow and such transmittance ratio of liquid crystal is saturated after the given delay time, as shown in FIG. 3. FIG. 3 shows an example of using liquid crystal material that needs time of 3 to 4 sub-fields in order to be optically saturated when the on-voltage is applied to this liquid crystal. Further, the liquid crystal material also needs a longer time than one sub-field even for the non-transmissive response time that the light transmittance ratio is transferred from a saturated state to a non-transmissive state at the time of applying off-voltage.

Namely, in the example of FIGS. 3A–3D, the light transmittance ratio of liquid crystal is changed to 4/10 of the saturated light transmittance ratio during the first sub-field period after applying on-voltage. Next, it is changed to 7/10 within a next sub-field period, namely during 2 sub-field periods after applying on-voltage. Then, it is changed to 8/10 during 3 sub-field periods after applying on-voltage. Further, it is changed to 10/10 during 4 sub-field periods after applying on-voltage.

On the other hand, in an example of FIGS. 3A–3D, the light transmittance ratio of liquid crystal is decreased by 3/10 of the saturated light transmittance ratio during the first sub-field period after applying off-voltage. Next, it is decreased by 5/10 during 2 sub-field periods after applying off-voltage. Then, it is decreased by 7/10 during 3 sub-field periods after applying on-voltage. Further, it is decreased by 9/10 during 4 sub-field periods after applying on-voltage.

Figure 3A:
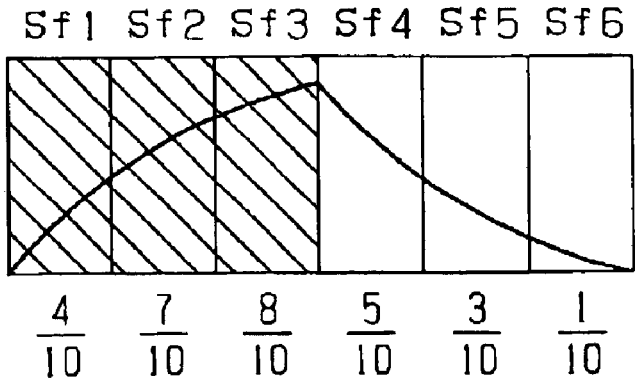
FIGS. 3A–3D are graphs that explain control of gray scale display in the present exemplary embodiment.

FIG. 3A shows an example applying on-voltage during 3 sub-field periods in the former part of a field period and applying off-voltage during 3 sub-field periods in the latter part of a field period. The transmittance ratio of liquid crystal rises up to 4/10 of the saturated light transmittance ratio during the first sub-field period, rises up to 7/10 of the saturated light transmittance ratio during the second sub-field period, and rises up to 8/10 of the saturated light transmittance ratio during the third sub-field period. Furthermore, the light transmittance ratio drops to 5/10 of the saturated light transmittance ratio during the fourth sub-field period, drops to 3/10 of it during the fifth sub-field period, and drops to 1/10 of it during the sixth sub-field period.

As mentioned above, brightness varies in proportion to the integral value of the light transmittance ratio when the cycle of sub-field drive (one field period in an example of FIGS. 3A–3D) is short enough. If a whole white image is displayed with the 100% transmittance ratio during all sub-field periods, brightness during a field period in FIG. 3A is $\{(4+7+8+5+3+1)/10\}\times 1/6 = 28/60$ of perfect white display.

Figure 3B:
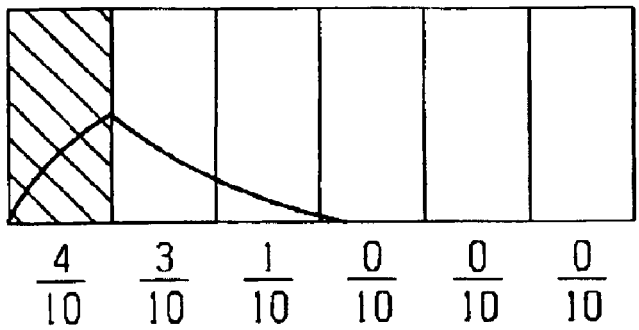
Figure 3C:
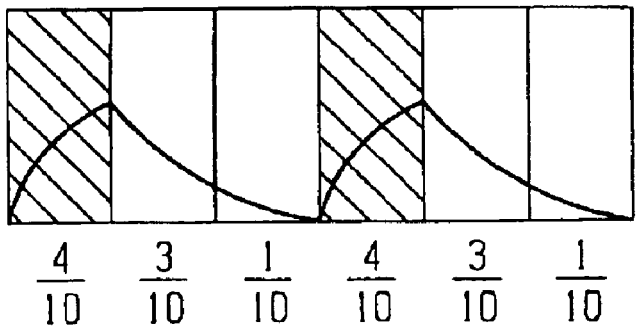
Figure 3D:
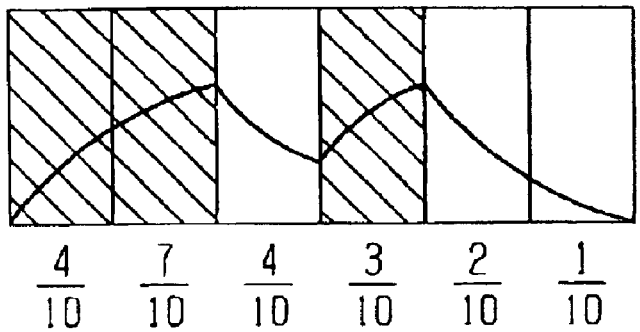

Similarly, in an example of FIG. 3B, brightness is $\{(4+3+1)/10\}\times 1/6 = 8/60$ of perfect white display. In addition, in an example of FIG. 3C, brightness is $\{(4+3+1+4+3+1)/10\}\times 1/6 = 16/60$ of perfect white display. In addition, in an example of FIG. 3D, brightness is $\{(4+7+4+3+2+1)/10\}\times 1/6 = 21/60$ of perfect white display.

When sub-field periods of applying on-voltage are simply continued, only the level of 6+1=7 of gray scale is obtained during 6 divided sub-field periods formed by dividing a field to 6 parts. On the other hand, in the case of FIGS. 3A–3D, it is possible to display numbers of levels of gray scale which are remarkably larger than 7-levels of gray scale by adopting sub-field drive pattern (hereinafter "pattern to place emphasis on gray-scale reproducibility") where a position of sub-field period of applying on-voltage and a position of sub-field period of applying off-voltage are arranged appropriately.

For example, if one field is divided into 16 sub-fields on a time axis, only 17 levels of gray scale are obtained by these 16 sub-fields when sub-field periods of applying on-voltage are simply continued. On the other hand, if arrangement of sub-fields of applying on-voltage and sub-fields of applying off-voltage is considered, 160 or more levels of gray scale can be available. Similarly, if one field is divided into 32 sub-fields on a time axis, 256 or more levels of gray scale can be available.

Thus, human eyes view brightness according to the integral value of the light transmittance ratio per unit time. Therefore, according to the exemplary embodiment, even if adjacent pixels have similar pixel values, it is possible to differentiate timing of flickering with sub-field drive by controlling timing of start of a unit time, which is independent from a display data field (hereinafter "reference field"). Hence, flickering can be reduced thereby.

In FIG. 1, an electro-optical device in the exemplary embodiment includes a display region 101*a* using liquid crystal as electro-optical material, a scanning line drive circuit 401 driving each pixel in this display region 101*a*, a data line drive circuit 500 and a drive circuit 301 supplying various kinds of signals to the scanning line drive circuit 401 and the data line drive circuit 500.

In an electro-optical device related to the exemplary embodiment, a transmissive substrate, such as a glass substrate, is used as an element substrate, transistors driving pixels and peripheral drive circuits are formed on the element substrate. In a display region 101*a* on the element substrate, plural scanning lines 112 are formed extending to the X (row) direction and plural data lines 114 are formed extending to the Y (column) direction. A pixel 110 is installed at each intersection of the scanning line 112 with the data line 114, these plural lines are arranged in a matrix.

The present exemplary embodiment is described for convenience of explanation on the premise that the total number of the scanning lines 112 is m and the total numbers of the data lines 114 is n (m, n are 2 or more integers respectively), illustrating m rows x n columns matrix type display device. However, the invention is not limited to such definition.

Figure 4:
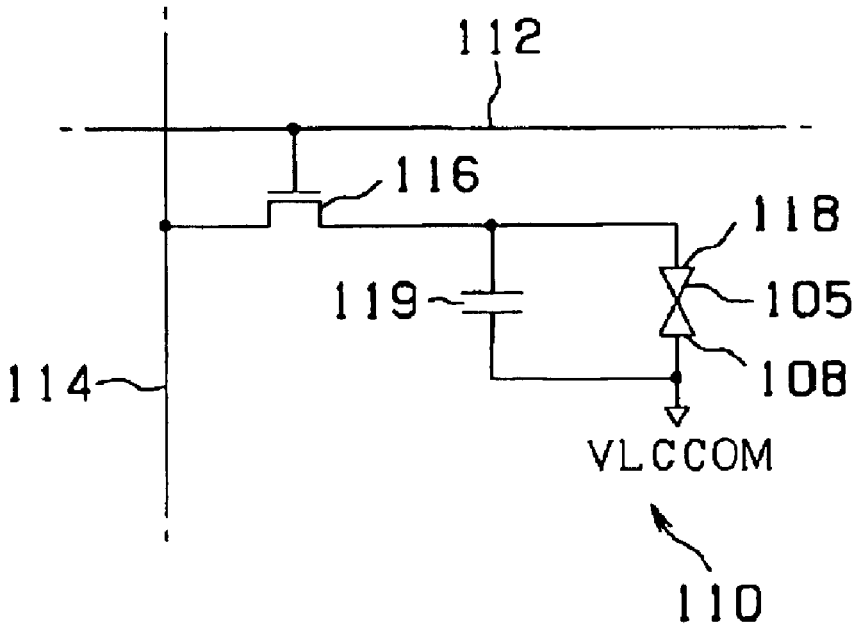
FIG. 4 is a schematic that shows a configuration of a picture element in FIG. 1.

FIG. 4 is a schematic showing a concrete structure of a pixel in FIG. 1. Each pixel 110 includes a transistor (pSi TFT) 116 as a switching device. The gate of the transistor 116 is connected to the scanning line 112, the source is connected to the data line 114 and its drain is connected to a pixel electrode 118. Liquid crystal 105 as an electro-optical material is sandwiched between the pixel electrode 118 and the opposite electrode 108, so as to form a liquid crystal layer. The opposite electrode 108 is a transmissive electrode that is formed on overall surface of the opposite substrate and located oppositely to the pixel electrode 118.

An opposite electrode voltage VLCCOM is applied to the opposite electrode 108. In addition, a storage capacitor 119 is formed between the pixel electrode 118 and the opposite electrode 108, and it accumulates electric charge along with the electrodes sandwiching the liquid crystal layer. Further, in an example of FIG. 4, the storage capacitor 119 is formed between the pixel electrode 118 and the opposite electrode 108, but it may be formed between the pixel electrode 118 and the ground potential GND or the pixel electrode 118 and the gate line. Further, it may also be formed between wirings which have the same potential as the opposite electrode voltage VLCCOM on the element substrate.

Each of the scanning signals G1, G2, . . . Gm is supplied to each of the scanning lines 112 from the scanning line drive circuit 401 described hereafter. All transistors 116 constituting pixels on each line are an on-state simultaneously by each scanning signal and an image signal supplied from the data line drive circuit 500 described hereafter to each of the data lines 114 is written into the pixel electrode 118. An oriented state of molecule groups of liquid crystal 105 varies in response to a potential difference between the pixel electrode 118 where an image signal is written and the opposite electrode 108, so that light is modulated, and gray scale display can be available.

As described above, according to the exemplary embodiment, one field is divided into plural sub-fields on a time axis and writing pixel data into each of pixels 110 is controlled every sub-field period.

Figure 2:
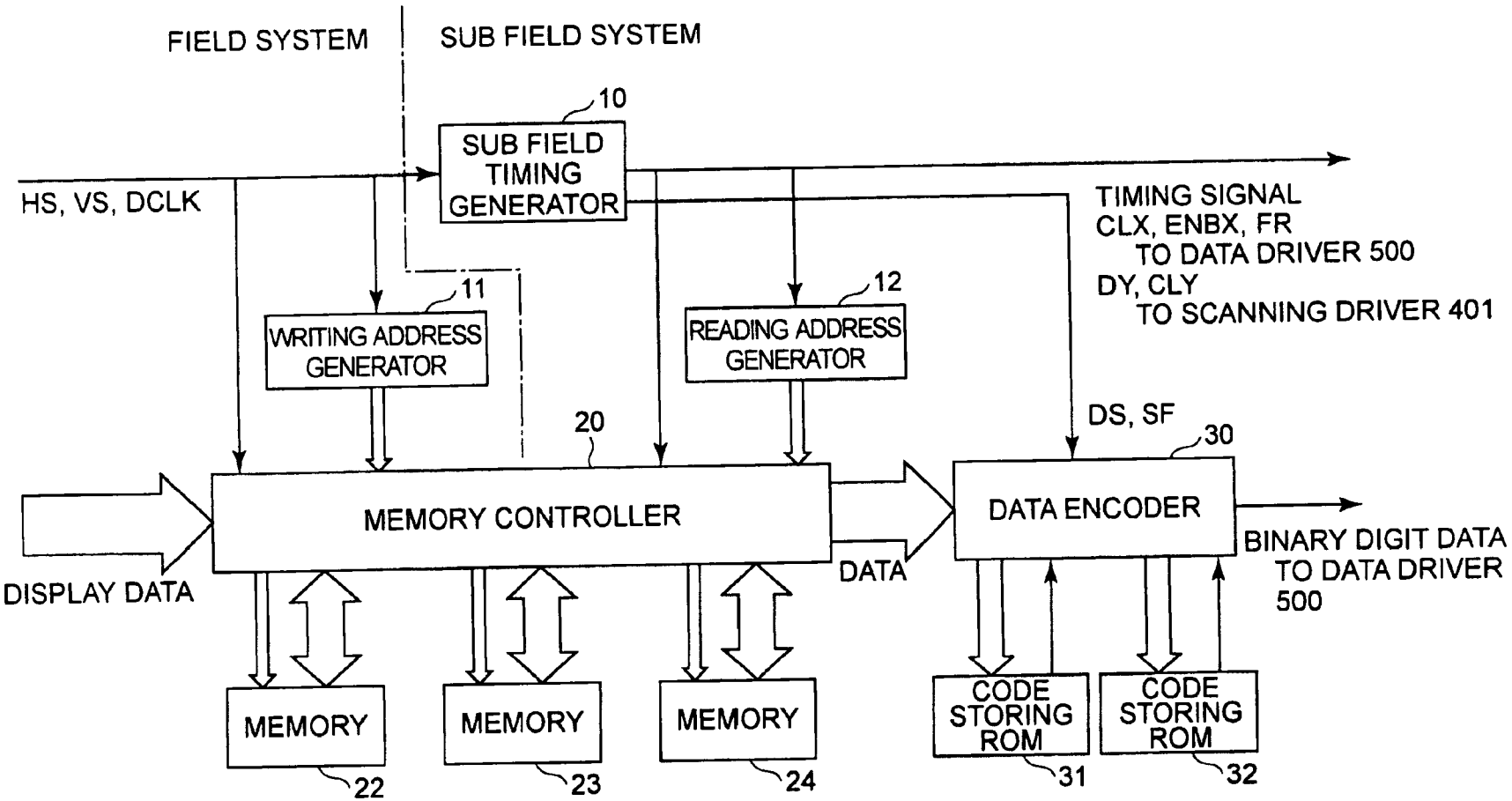
FIG. 2 is a schematic that shows a structure of the drive circuit 301 in FIG. 1.

Next, a structure of drive system to drive a display region is explained. FIG. 2 is a schematic showing a specific structure of the drive circuit 301 in FIG. 1.

In FIG. 2, a vertical synchronizing signal Vs supplied from the outside, a horizontal synchronizing signal Hs and a dot clock DCLK are inputted into the sub-field timing generator 10. The sub-field timing generator 10 produces a timing signal to be used in the sub-field system on the basis of the inputted horizontal synchronizing signal Hs, the vertical synchronizing signal Vs and the dot clock DCLK.

Namely, the sub-field timing generator 10 produces a data transfer clock CLX, a date enable signal ENBX, a polarity turning over signal FR, which are signals to drive a display, and outputs them to the data line drive circuit 500. Further, the sub-field timing generator 10 produces a scanning start pulse DY, and a scanning side transfer clock CLY, and outputs them to a scanning line drive circuit 401. Further, the sub-field timing generator 10 produces a data transfer start pulse DS, and a sub-field identification signal SF, which are used inside of a controller, and outputs them to a data encoder 30.

The polarity turning over signal FR is a signal of which polarity turns over every one field. The scanning start pulse DY is a pulse signal outputted at start point of each sub-field and the scanning line drive circuit 401 outputs gate pulses (G1 . . . Gm) sequentially by inputting the scanning start pulse DY into the scanning line drive circuit 401.

As described above, one field is divided into plural sub-fields Sf1 . . . Sfs on a time axis and binary digits voltage is applied to the liquid crystal layer in response to gray scale data every sub-field period. The start pulse DY is a signal showing switch of each of sub-fields, and write scanning to an display area is implemented every output of this pulse.

The scanning side transfer clock CLY is a signal that regulates scanning speed of the scanning side (Y side). Gate pulses (G1 . . . Gm) synchronize with this transfer clock and are transferred every scanning line. The data enable signal ENBX determines timing of outputting data stored in an X bit shift register 510, described below, in the data line drive circuit 500 in parallel with several pixels in horizontal direction. The data transfer clock CLX is a clock signal to transfer data to the data line drive circuit 500. The data transfer start pulse DS regulates timing of starting data transfer from the data encoder 30 to the data line drive circuit 500 and this pulse is sent to the data encoder 30 from the sub-field timing generator 10. The sub-field identification signal SF informs the data encoder 30 of the numbered pulse (sub-field).

The drive voltage generation circuit, which is not illustrated in the figure, generates voltage V2 producing the scanning signal and gives it to the scanning line drive circuit 401, generates voltage V1, −V1, V0 producing the data line drive signal and gives them to the data line drive circuit 500. Further, it generates opposite electrode voltage VLCCOM and gives it to the opposite electrode 108.

Voltage V1 is a data line drive signal that is outputted to the liquid crystal layer as a high level positive signal referring to voltage V0, when polarity turning over signal FR is high level (hereinafter "H level"). Voltage-V1 is a data line drive signal that is outputted to the liquid crystal layer as a high level negative signal referring to voltage V0, when polarity turning over signal FR is low level (hereinafter "L level").

On the other hand, inputted display data is supplied to a memory controller 20. A writing address generator 11 specifies a position of data on an image, which is sent at that time, by the horizontal synchronizing signal Hs, the vertical synchronizing signal Vs, and the dot clock DCLK that are inputted by the outside. Based on this specified result, it produces a memory address to store display data in memories 23,24 and outputs it to the memory controller 20.

A reading address generator 12 specifies a position of data on an image, which is displayed at that time, by a timing signal of sub-field system produced by the sub-field timing generator 10. Based on this specified result, it produces memory addresses to read data in memories 22 to 24 based on the same rule as writing and outputs them to the memory controller 20.

The memory controller 20 writes inputted display data to the memories 22 to 24 and controls reading such written data from memories 22 to 24. Namely, the memory controller 20 writes data inputted from the outside to the memories 22 to 24 synchronously with the timing signal DCLK in response to an address produced in the writing address generator 11. Further, reading is implemented synchronously with a timing signal CLX produced by the sub-field timing generator 10 in response to an address produced in the reading address generator 12. The memory controller 20 outputs read data to the data encoder 30.

In the sub-field drive, data are written to a pixel every sub-field. Therefore, it is necessary to produce the binary digits data that determine on and off of a sub-field based on display data, which are held in the field memory and read in the field memory every sub-field.

The memories 22 to 24 are installed for this reason. One of the memories 22, 24 is used to write inputted data and another is used to read data. Such roles of the memories 22 to 24 are switched by the memory controller 20 sequentially every field. Namely, the memory controller 20 reads data from the same address in the two memories synchronously with timing signal, and outputs read data to the data encoder 30 as the next step in parallel.

Finally, display data of three fields, such as the current data (on the way of writing), the data in a previous field and the data in a further two previous fields are stored in three memories 22 to 24.

Further, display data in a previous field and display data in a further two previous fields are outputted in parallel to the data encoder 30.

The data encoder 30 produces an address in order to read necessary data from the code storing ROMs 31, 32 by data, sent from the memory controller 20 and the sub-field identification signal SF, sent from the sub-field timing generator 10. Then, by using this address, it reads data from the code storing ROMs 31, 32 and outputs them to the data line drive circuit 500 synchronously with a data transfer start pulse DS.

The code storing ROMs 31, 32 store a group of binary digit signals Dd of H level or L level for making a pixel be on-state or off-state every each sub-field toward gray scale data displayed in a pixel (a code specifying whether each of sub-fields within one field is on or off). When the code storing ROMs 31, 32 input gray scale data of each pixel and sub-field to write as an address, they output one bit data (the binary digit signal (data) Dd) in response to its sub-field.

According to the exemplary embodiment, the code that places emphasis on gray-scale reproductiveness in response to a still image is stored in the code storing ROM 31 and the code that places emphasis on responsiveness (sight recognition for a moving image) is stored in the code storing ROM 32.

In this exemplary embodiment, the data encoder 30 selects the mode of placing emphasis on sight recognition of a moving image and the mode of placing emphasis on gray scale reproductiveness, uses the code stored in the code storing ROM 32 at the time of the mode of placing emphasis on sight recognition of a moving image and uses the code stored in the code storing ROM 31 at the time of the mode of placing emphasis on gray scale reproductiveness.

The data encoder 30 determines a display mode depending on kinds of inputted data, for example, whether these are image data from a personal computer or image data from a VTR, or by automatic -judging the contents of inputted signals. Further, it is preferable that the data encoder 30 determines a display mode by automatic-judging the contents of inputted signals and sets a common display mode for all over the image in this case, or determines a display mode every display area, for example, a unit of single pixel, or a unit of four pixels. Furthermore, the data encoder 30 may set a display mode designated by a user's operation.

Figure 7:
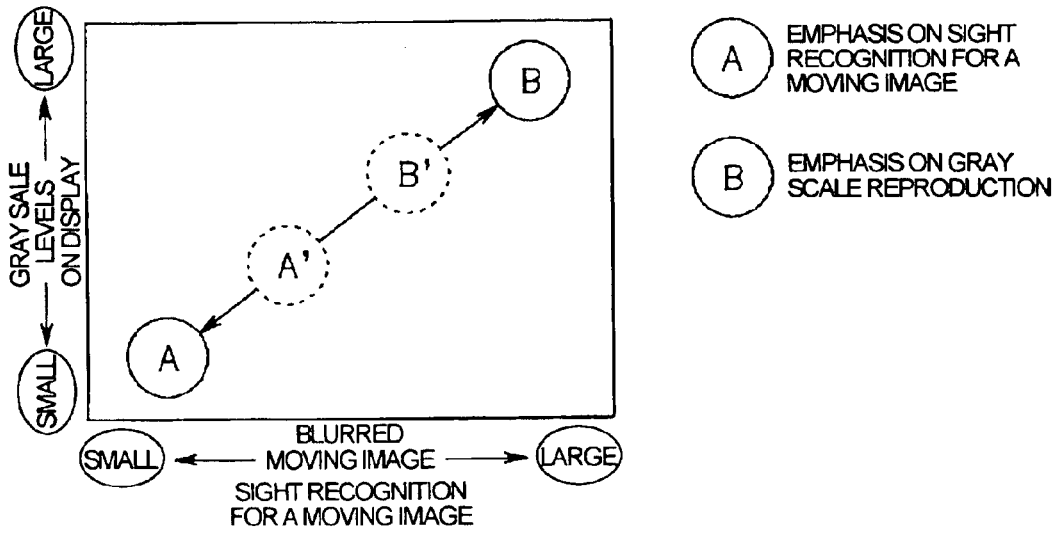
FIG. 7 is a schematic to explain a method of determining a display mode.

For example, the data encoder 30 can determine a display mode in response to whether display data is based on a moving image or a still image. FIG. 7 is a schematic of a method of determining a display mode in this case.

As shown in FIG. 7, if levels of displayed gray scale are desired to increase with permitting blurred image by moving somewhat, the data encoder 30 selects the mode of placing emphasis on gray scale reproductiveness shown as B in FIG. 7. On the other hand, if levels of displayed gray scale are desired to decrease without permitting blurred image by moving somewhat, it selects the mode of placing emphasis on sight recognition of a moving image shown as A in FIG. 7. Intermediate modes A', B' of these modes A, B can also be available.

Figure 8A:
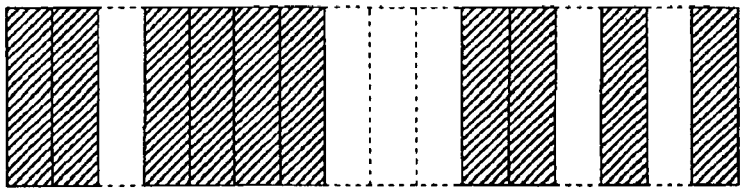
FIGS. 8A–8C are schematics to explain a description of a code stored by a code storing read only memory 31, 32 in FIG. 2.
Figure 8B:
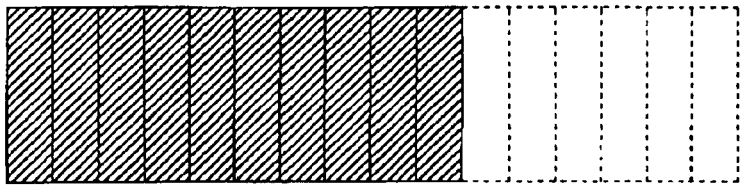
Figure 8C:
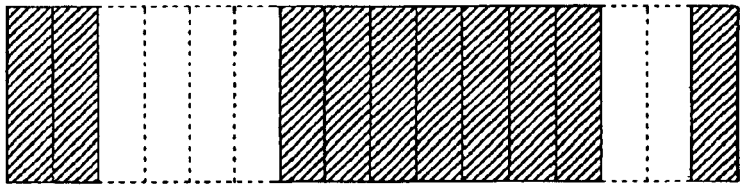
Figures 9A, 9B, 9C, 9D, 9E, 9F:
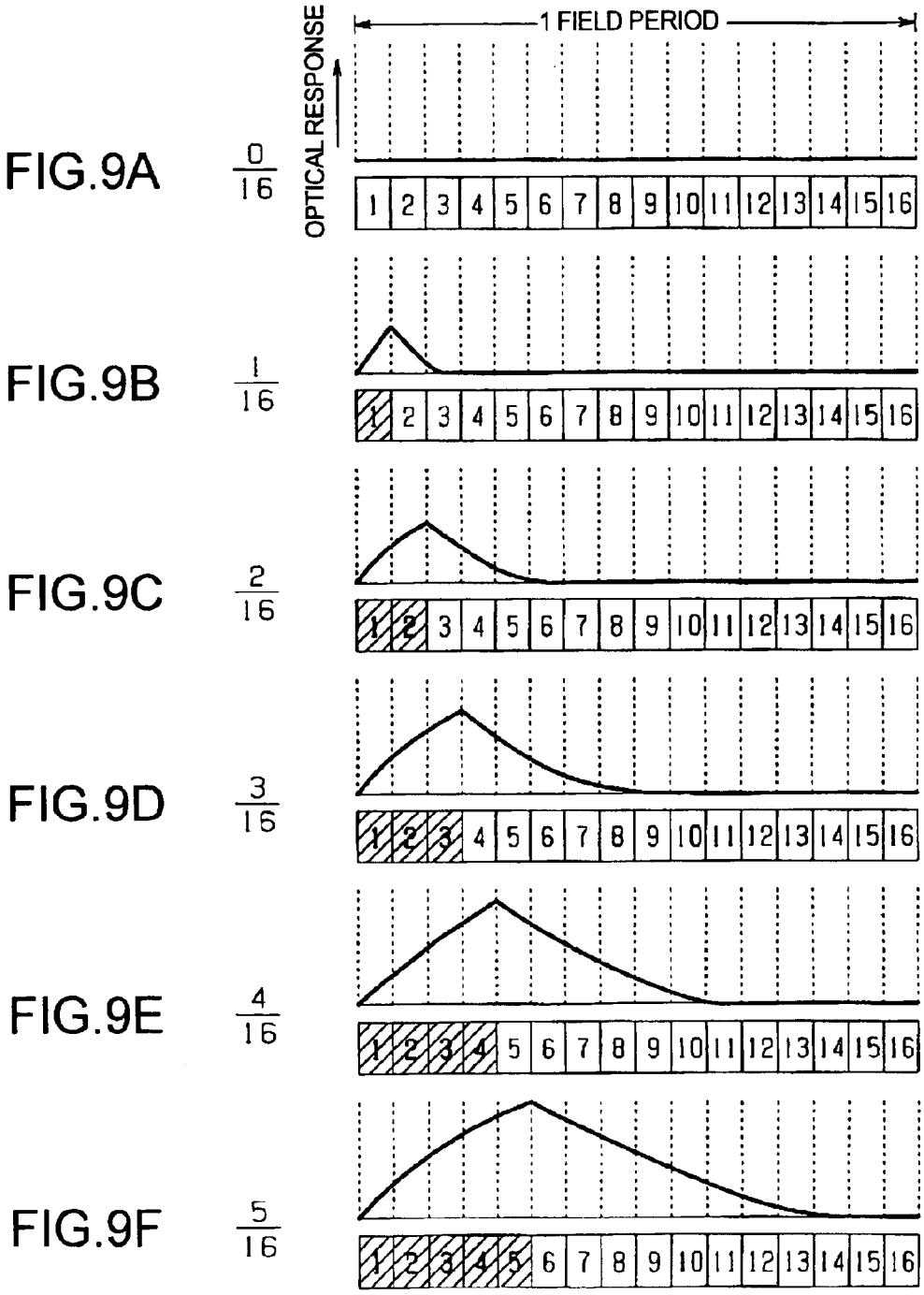
FIGS. 9A–9F are schematics to explain a code of a mode for emphasis on sight recognition of a moving image.
Figures 10G, 10H, 10I, 10J, 10K:
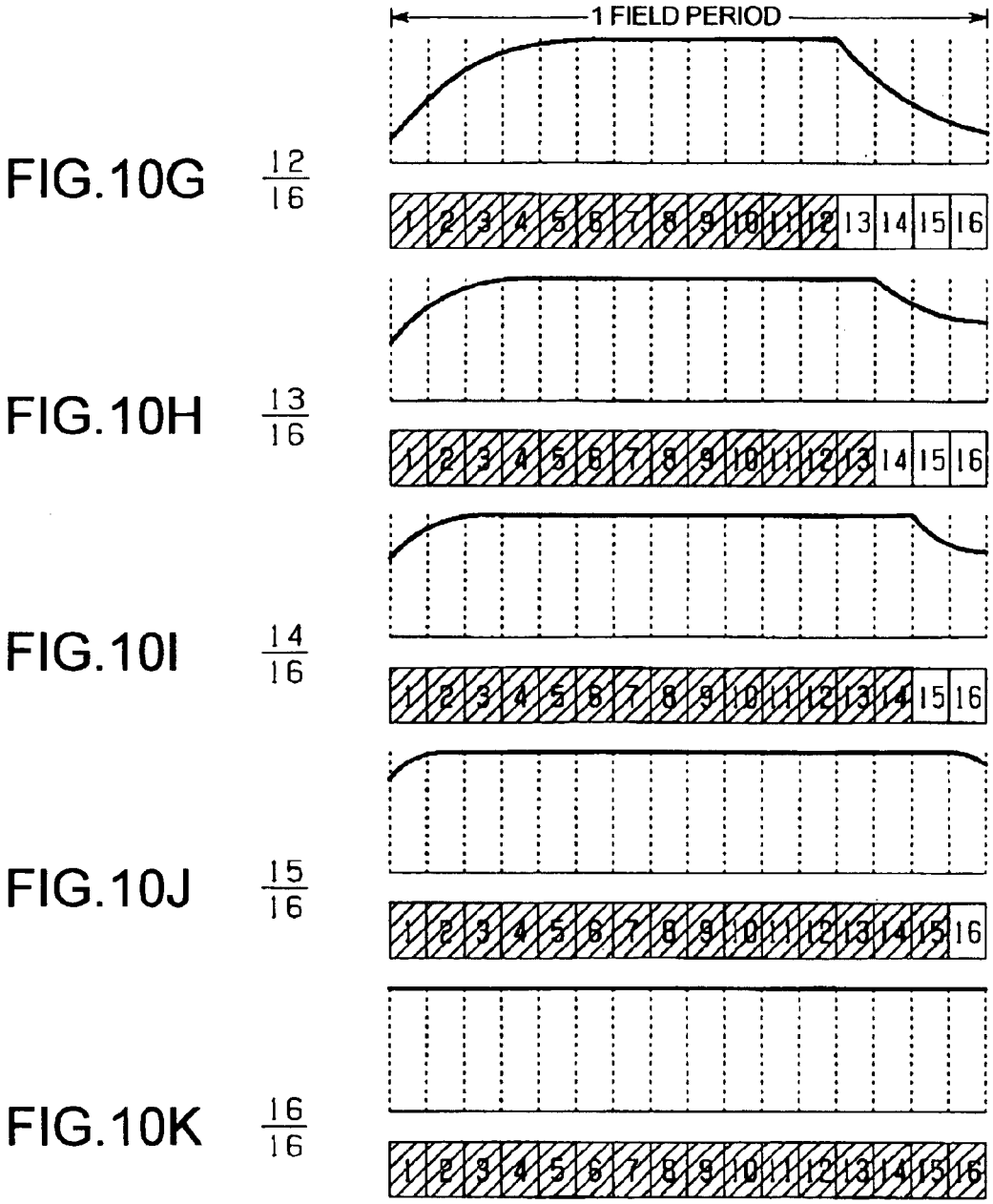
FIGS. 10G–10K are schematics to explain a code of a mode for emphasis on sight recognition of a moving image.

FIGS. 8A–8C are schematics of a code example stored by code storing ROMs 31, 32. The example of FIGS. 8A–8C is the example that one field is divided into 16 sub-fields on a time axis. An oblique lines portion of FIG. 8 shows a sub-field period of applying on-voltage and a plain portion shows a sub-field period of applying off-voltage. The code storing ROMs 31, 32 store coded binary digits data to designate on and off of each field by the amount of one field.

If an image is displayed with the 100% transmittance ratio during all periods of sub-fields and perfect white image is displayed thereby, brightness in each field period of FIGS. 8A to C is about 60%, 50% or 55% of the perfect white display, respectively.

In the example of FIGS. 8A–8C, the number of sub-fields of applying on-voltage is the same for all of FIG. 8A to FIG. 8C. But these figures show that brightness is changed in response to arrangement of on and off pulses, namely, position of sub-field periods of applying on-voltage and position of a sub-field periods of applying off-voltage.

Further, the code of FIG. 8B shows the code of placing emphasis on sight recognition of a moving image (responsiveness) and that of FIGS. 8A and C is the code of placing emphasis on gray scale reproductiveness.

In the case of the code of placing emphasis on sight recognition of a moving image of FIG. 8B where sub-field periods of applying on voltage are simply continued, only 17 levels of gray scale are obtained by 16 sub-fields. On the other hand, in the case of the code of placing emphasis on gray scale reproductiveness of FIGS. 8A and C where sub-fields for on and off are arranged appropriately, 160 or more levels of gray scale can be displayed depending on its combination.

Figure 13:
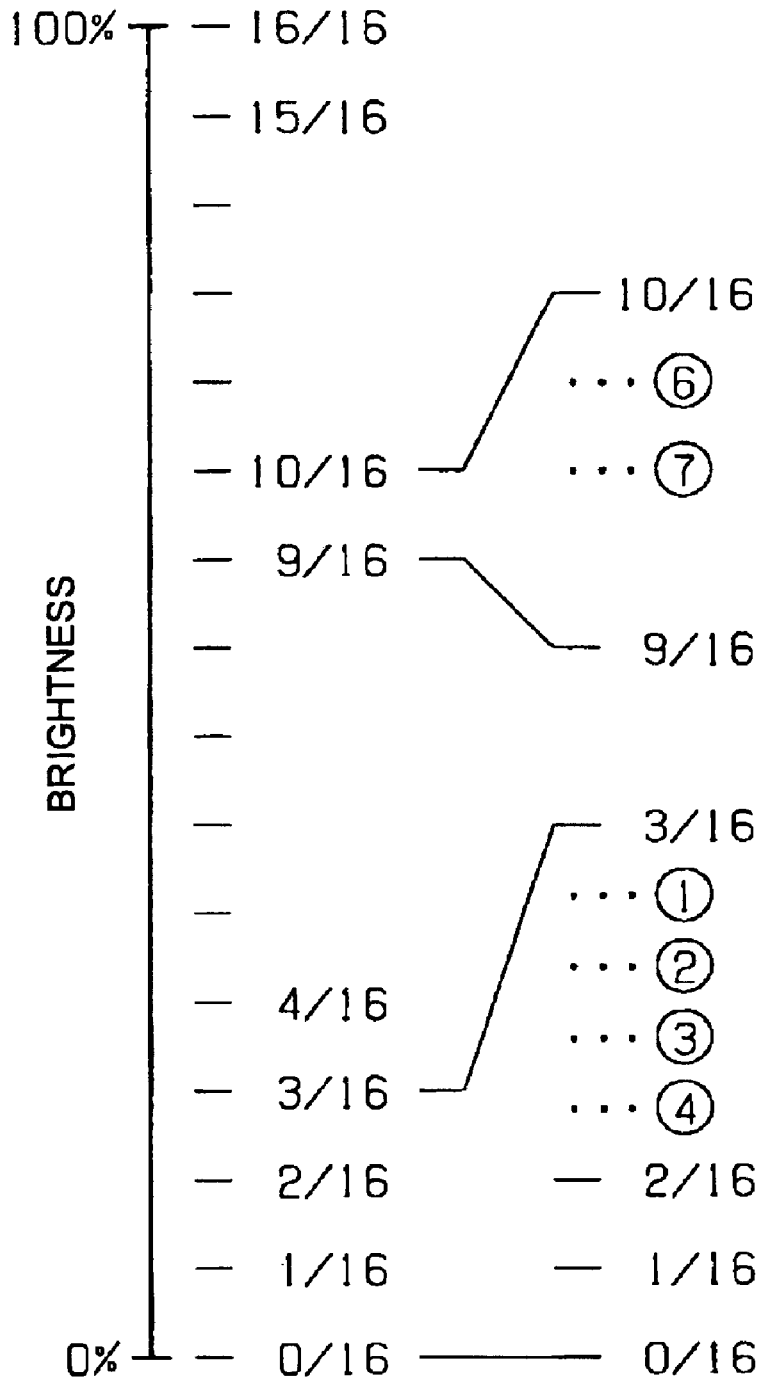
FIG. 13 is a schematic to show gray scale (brightness) obtained by codes shown in FIGS. 9A–9F and 12A–12C.

FIG. 9A to FIG. 13 are schematic codes of placing emphasis on sight recognition of a moving image, codes of placing emphasis on gray scale reproductiveness and codes having intermediated characteristic between them. In FIG. 9A to FIG. 12C, a horizontal axis shows each of sub-field periods of one field period, a vertical axis shows optical response (the transmittance ratio), oblique line portions show sub-fields to turn on and plain portions show sub-fields to turn off. FIG. 13 shows levels of gray scale obtained by each code shown in FIG. 9A to FIG. 12 (brightness).

FIGS. 9A–9F and FIGS. 10G–10K show codes of placing emphasis on sight recognition of a moving image (responsiveness). FIGS. 9A–F show codes of giving $^{0}/_{16}$th level of gray scale, $^{1}/_{16}$th level and $^{5}/_{16}$th level respectively. FIGS. 10G–K show $^{12}/_{16}$th level, $^{13}/_{16}$th level and $^{16}/_{16}$th level respectively. Namely, the code of codes of placing emphasis on sight recognition of a moving image is to supply on-voltage continuously by the number of sub-fields in response to gray scale from starting sub-fields.

FIGS. 11A–11D shows codes of placing emphasis on gray scale reproductiveness. Brightness ①. . . ④given by examples of FIGS. 11A–11D is equivalent to ①. . . ④of FIG. 13. Namely, four levels of gray scale between t $^{2}/_{16}$th level and $^{3}/_{16}$th level can be available according to setting in FIGS. 11A–11D.

FIGS. 12A–12C show the codes of both placing emphasis on sight recognition of a moving image and placing emphasis on gray scale reproductiveness. Brightness ⑥, ⑦given by examples of FIGS. 12B and C are equivalent to ⑥, ⑦in FIG. 13. Namely, two levels of gray scale between $^{9}/_{16}$th level and $^{10}/_{16}$th level can be available according to setting in FIGS. 12A–12C. Namely, levels of gray scale are larger than that of examples of FIGS. 9A–10K and smaller than that of examples of FIGS. 11A–11D. On the other hand, on-state sub-fields are located relatively and intensively in the former end of a field so that the transmittance ratio at the latter end of a field is reduced and sight recognition of a moving image is enhanced.

In addition, if codes to place emphasis on both sight recognition of a moving image and gray scale reproductiveness are adopted, it is preferable that a code storing ROM storing this codes is added so that it is selected by the data encoder 30.

It is assumed that the data encoder 30 determines whether an image is moving or still every pixel. In this case, the data encoder 30 detects an edge part of a moving image. For example, it determines that it is an edge part of a moving image when change of brightness of display data (gray scale of display data) is greater than or equal to the predetermined reference value. Namely, the data encoder 30 compares data of two fields before and after a specific field, sent from the memory controller 20 every pixel and obtains the difference among levels of gray scale of pixels located at the same position in an image. If levels of gray scale of inputted display data are 256, the data encoder 30 determines that this data is not an edge part of a moving image when obtained difference of levels of gray scale is within ±50. Then, it reads codes in the code storing ROM 31. On the other hand, when such difference is over ±50, it read a code in the code storing ROM 31 by judging that data is an edge part of a moving image.

In FIG. 1, the scanning line drive circuit 401 transfers scanning start pulse DY, supplied at start point of a sub-field, in response to the scanning side transfer clock CLY and supplies it as scanning signals G1, G2, G3, . . . , Gm sequentially and exclusively to each of the scanning lines 112.

The data line drive circuit 500 latches n pieces of binary digits data corresponding to number of data lines. Then, it supplies n pieces of latched binary digits data as data signals d1, d2, d3, . . . , dn to the data lines 114.

Figure 5:
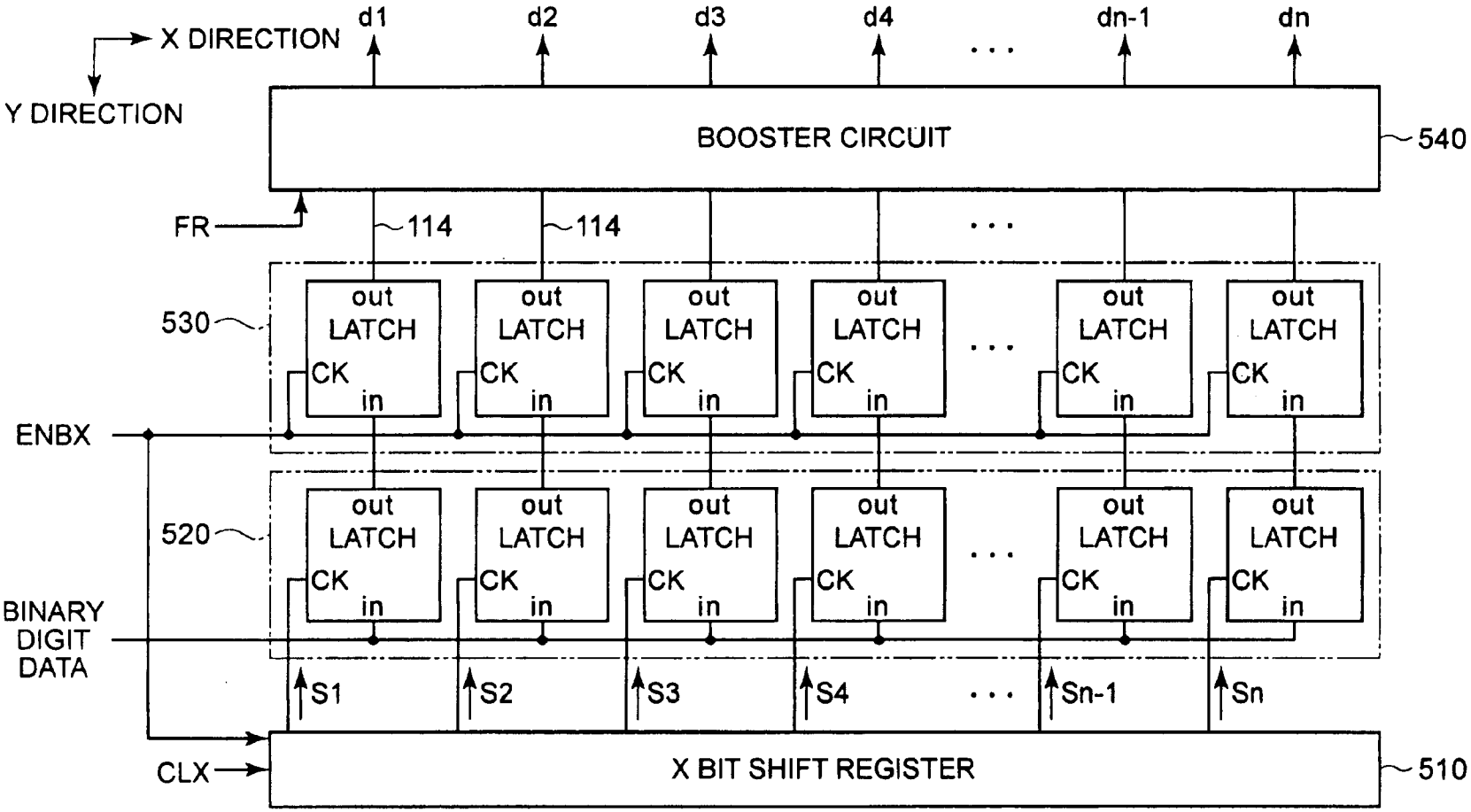
FIG. 5 is a schematic that shows a configuration of a data line drive circuit 500 in FIG. 1.

FIG. 5 is a schematic showing a specific structure of the data line drive circuit 500 in FIG. 1. The data line drive circuit 500 includes an X bit shift register 510, a first latch circuit 520 for pixels in horizontal direction, a second latch circuit 530, and a booster circuit 540 for pixels in horizontal direction.

The X bit shift register 510 transfers the data enable signal ENBX, supplied at start timing of a horizontal scanning period, corresponding to the clock signals CLX and supplies it sequentially and exclusively as latch signals S1, S2, S3, . . . , Sn to the first latch circuit 520. The first latch circuit 520 latches binary digits data sequentially at the time of falling of the latch signals S1, S2, S3, . . . , Sn. The second latch circuit 530 latches each of binary digits data all at once, latched by the first latch circuit 520, at the time of rising of the data enable signal ENBX and supplies them as data signal d1, d2, d3, . . . , dn to each of data lines 114, respectively, via the booster circuit 540.

Figure 6:
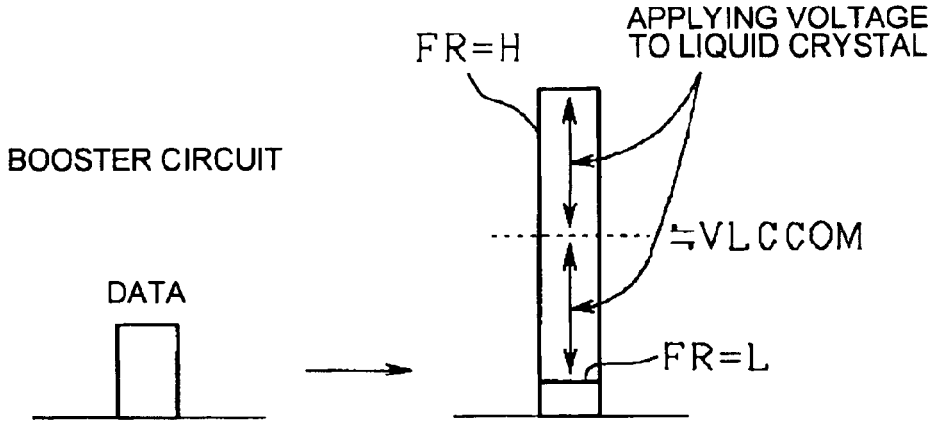
FIG. 6 is a schematic to explain actuating of a booster circuit 540.

The booster circuit 540 is provided with polarity turning over function and booster function. The booster circuit 540 boosts voltage based on a polarity turning over signal FR. FIG. 6 shows operation of the booster circuit 540. For example, if the polarity turning over signal FR is H level, the booster circuit 540 outputs plus voltage of driving liquid crystal, when it inputs data signal making a pixel be an on-state. In addition, if the polarity turning over signal FR is L level, it outputs negative voltage of driving liquid crystal, when it inputs data signal making a pixel to be in an on-state. In the case of data making a pixel to be an off-state, it outputs VLCCOM potential regardless of a state of the polarity turning over signal FR.

Further, as above mentioned, in the data line drive circuit 500, the first latch circuit 520 latches binary digits signals with point at time in a certain horizontal scanning period. Then, the second latch circuit 530 supplies them all at once as data signals d1, d2, d3, . . . , dn to each of the data lines 114 in the next horizontal scanning period thereafter. Hence, the data encoder 30 compares operation in the scanning line drive circuit 401 with it in the data line drive circuit 500 and outputs binary digit signal Dd at the timing of 1 horizontal scanning period ahead.

Figure 14:
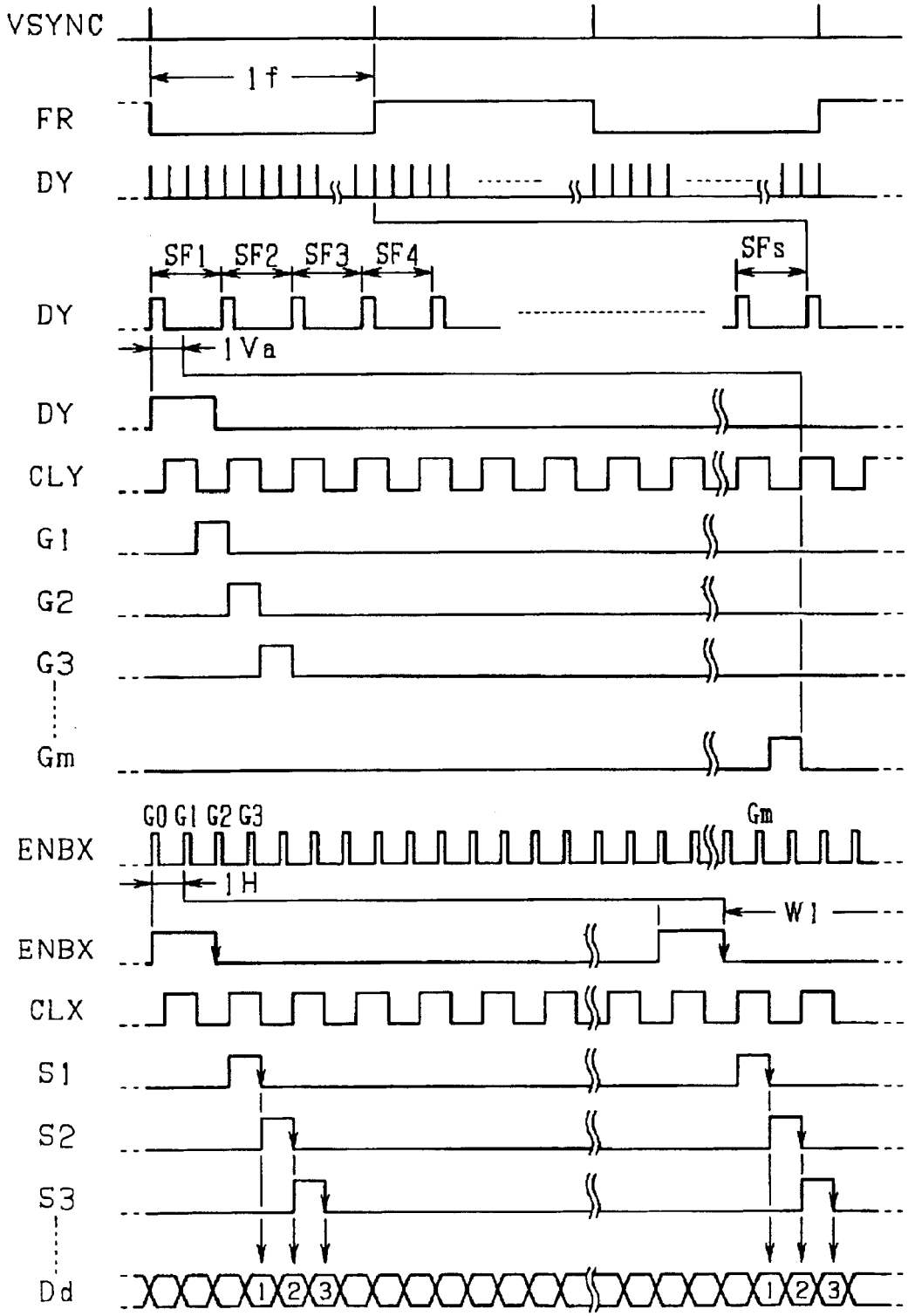
FIG. 14 is a timing chart to explain an operation of the electro optical device of the present exemplary embodiment.

Next, an operation of this exemplary embodiment with this structure is explained with reference to FIG. 14. FIG. 14 is a timing chart to explain an operation of an electro-optical device of this exemplary embodiment.

First, drive of a pixel in a sub-field is described. A polarity turning over signal FR is the signal that turns level over every one field period (1*f*). Start pulse DY is generated at the start of each of sub-fields Sf1 . . . Sfs. In a field period (1*f*) when the polarity turning over signal FR is L level, start pulse DY is supplied so that scanning signals G1, G2, G3, . . . , Gm are outputted exclusively and sequentially by transfer corresponding to clock signal CLY in the scanning line drive circuit 401. An example of FIGS. 12A–12C shows the case when one field is divided into S pieces of sub-fields having the same time width on a time axis.

The scanning signals G1, G2, G3, . . . , Gm, have a pulse width corresponding to a half cycle of the scanning side transfer clock CLY. Further, after the start pulse DY is supplied, the scanning signal G1 corresponding to the first scanning line 112, counted from the top, is outputted, delay of at least a half cycle of the clock signal CLY after the clock signal CLY rises first. Therefore, 1 clock (G0) of data enable signal ENBX is supplied to the data line drive circuit 500 by the time when the scanning signal G1 is outputted after the start pulse DY is supplied.

Firstly, the case of supplying 1 clock (G0) of the data enable signal ENBX is explained. When the 1 clock (G0) of the data enable signal ENBX is supplied to the data line drive circuit 500, the latch signals S1, S2, S3, . . . , Sn are outputted exclusively and sequentially within a horizontal scanning period (1H) by transfer corresponding to the data transfer clock CLX. Here, the latch signals S1, S2, S3, . . . , Sn have a pulse width corresponding to a half cycle of the data transfer clock CLX.

In this case, at the time of falling of the latch signal S1, the first latch circuit 520 in the FIG. 5 latches binary digits data for the pixel 110 corresponding to the intersection between the first scanning line 112 counted from the top and the first data line 114 counted from the left. Next, at the time of falling of the latch signal S2, it latches binary digits data for the pixel 110 corresponding to the intersection between the first scanning line 112 counted from the top and the second data line 114 countered from the left. Similarly, it latches binary digits data for the pixel 110 corresponding to the intersection between the first scanning line 112 counted from the top and the n -numbered data line 114 counted from the left sequentially.

Hence, at first, in FIG. 1, the binary digits data corresponding to pixels on a line, intersected with the first scanning line 112 counted from the top are latched with point at a time by the first latch circuit 520. Here, the data encoder 30 produces binary digits data corresponding to each sub-field sequentially from display data of each pixel at the timing of latch by the first latch circuit 520 and outputs them.

Next, when the clock signal CLY falls and the scanning signal G1 is outputted, the first scanning line 112 counted from the top in FIG. 1 is selected. As a result, all transistors 116 of pixels 110 corresponding to a line intersected with the scanning line 112 are in an on-state.

On the other hand, at the time of falling the clock signal CLY, the data enable signal ENBX (G1) is outputted again. At the timing of rising of the signal ENBX, the second latch circuit 530 supplies binary digits data, latched with point at a time by the first latch circuit 520 to each of the corresponding data lines 114 as data signals d1, d2, d3, . . . , dn via the booster circuit 540. Hence, at the pixels on the first line counted from the top, data signals d1, d2, d3, . . . , dn are written simultaneously thereby.

In parallel with this writing, in FIG. 1, the binary digits data corresponding to pixels on a line, intersected with the second scanning line 112 counted from the top are latched with point at a time by the first latch circuit 520.

Next, binary digits data applied to each pixel in each sub-field is explained. It is assumed that the data encoder 30 determines automatically whether data is an edge part of a moving image or not, for each pixel and decides whether a display mode is a mode to place emphasis on sight recognition of a moving image or a mode to place emphasis on gray scale reproductiveness. The memory controller 20 gives inputted display data to the memories 22 to 24 sequentially and makes each of the memories 22 to 24 store display data for 3 fields. Namely, in order to detect an edge part of a moving image from displayed image, the memory controller 20 makes two memories store display data for the 2 fields before and after a specific field and writes the current displayed data to the rest of a memory.

Then, the memory controller 20 reads data for two fields that are a field before one field and a field before two fields with respect to the field of inputted displayed data and supplies them to the data encoder 30 in parallel.

The data encoder 30 determines different levels of gray scale among pixels of which positions on an image are the same if it receives display data before and after one field. It is assumed that displayed data are 8 bits gray scale data. In this case, display data have information of the 256 levels of gray scale. The data encoder 30 determines whether different levels of gray scale among pixels of which positions on an image are within ±50 or not.

Here, it is assumed that different levels of gray scale among pixels of which predetermined positions on an image are within ±50 before and after one field. In this case, the data encoder 30 determines that this object pixel is not located at an edge part of a moving image. Then, in this case, the data encoder 30 reads codes based on display data (gray scale data) from the code storing ROM 31.

Figure 15:
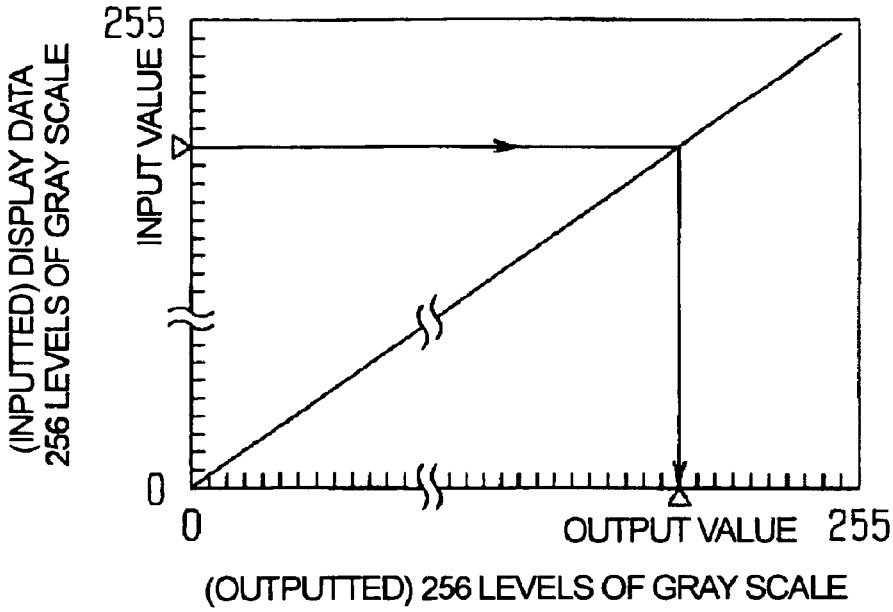
FIG. 15 is a graph to show output of data encoder 30 in a mode for emphasis on gray scale reproductiveness.

FIG. 15 is a graph showing output from the data encoder 30 at the time of the mode to place emphasis on gray scale reproductiveness where the vertical axis is gray scale (brightness) of inputted display data and the horizontal axis is gray scale (brightness) based on codes selected by the data encoder 30. FIG. 15 shows an example where one field is divided into 63 sub-fields equally on a time axis.

Specifically, 256 or more levels of gray scale can be available by 63 sub-fields at the time of the mode to place emphasis on gray scale reproductiveness. Therefore, in this case, as shown in FIG. 15, gray scale of inputted display data can be reproduced as they are.

Next, it is assumed that the difference of gray scale is over ±50 before and after one field with respect to an object pixel located at a predetermined position. In this case, the data encoder 30 determines that this object pixel is an edge part of a moving image. In this case, the data encoder 30 reads a code based on display data (gray scale data) from the code storing ROM 32.

Figure 16:
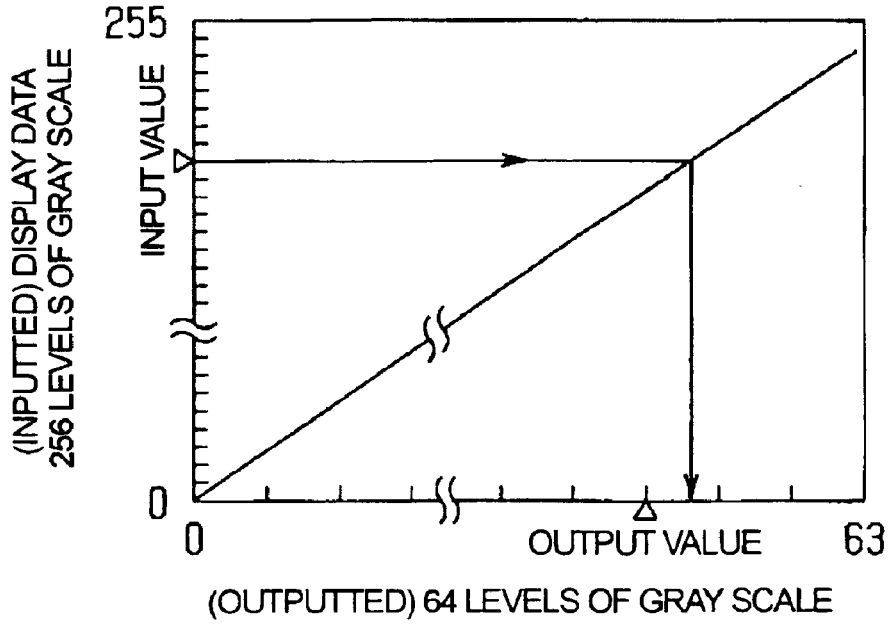
FIG. 16 is a graph to show output of data encoder 30 in a mode for emphasis on sight recognition of a moving image.

FIG. 16 is a graph showing output from the data encoder 30 at the time of the mode to place emphasis on sight recognition of a moving image (responsiveness) where the vertical axis is gray scale (brightness) of inputted display data and the horizontal axis is gray scale (brightness) based on codes selected by the data encoder 30. FIG. 16 also shows an example where one field is divided into 63 sub-fields equally on a time axis.

Specifically, 64 levels of gray scale can be available by 63 sub-fields at the time of the mode to place emphasis on sight recognition of a moving image. Therefore, in this case, as shown in FIG. 16, gray scale of inputted display data cannot be always reproduced as they are. Therefore, in this case, the data encoder 30 reads a code to obtain gray scale (brightness) of which level is smaller than gray scale (brightness) of inputted display data and the most adjacent to it.

For example, when levels of gray scale of inputted display data are $^{202}/_{256}$, the data encoder 30 reads a code to give $^{50}/_{64}$ levels of gray scale from the code storing ROM 32.

Further, when gray scale that coincides with gray scale of inputted display data is not sorted in the code storing ROM, a code, to obtain gray scale of which levels is smaller than that of gray scale of inputted display data and the most adjacent to them, is used. This is based on a reason why the following point is considered. Namely, it is rare that the mode to place emphasis on sight recognition of a moving image is continued. For example, the mode for placing emphasis on sight recognition of a moving image can be recovered only within one field so that deterioration of image quality is relatively small and brightness at the end portion of a field is darkened if the value of brightness is set be small. Hence, responsiveness can be enhanced.

The data encoder 30 outputs a code of an object pixel before 2 fields with respect to the current inputted display data as binary digit data to the data line drive circuit 500.

Thus, displaying with both the device to place emphasis on sight recognition of a moving image and the mode to place emphasis on gray scale reproductiveness can be available for each unit of a pixel.

Therefore, according to the electro optical device related to the present exemplary embodiment, the mode to place emphasis on sight recognition of a moving image or the mode to place emphasis on gray scale reproductiveness can be selected at the time of gray scale display for each of plural pixels.

Further, a similar operation is repeated until the scanning signal Gm corresponding to the m numbered scanning line 112 thereafter. Here, the data signal written in the pixel 110 is maintained until writing in the next sub-field Sf2.

A similar operation is repeated every time when the scanning start pulse DY that regulates start of a sub-field is supplied.

Furthermore, when the polarity turning over signal FR is turned over to H level after one field elapses, a similar operation is repeated for every each sub-field.

Thus, in the present embodiment, the mode to place emphasis on sight recognition of a moving image (responsiveness), where sub-fields for on-sate are collected intensively in the former part of a filed, or the mode for placing emphasis on gray scale reproductiveness where locations of sub-fields for on-state and for off-state are set appropriately so as to increase levels of gray scale can be selected. Hence, sight recognition of a moving image can be enhanced and gray scale display can be available simultaneously.

Here, in the electro-optical device of the exemplary embodiment, a display mode is normally black. However, even if a display mode of an electro-optical device is normally white, the above-mentioned structure can be applied. In such case, it is preferable that the above mentioned "on-voltage (on state)" becomes a no voltage applied state, and "off-voltage (off state)" becomes a saturated voltage in which transmittance ratio of liquid crystal becomes the smallest.

Further, in the above-mentioned exemplary embodiment, a drive device is Poly-Si (polycrystalline silicon) TFT. However, it is not limited to this. The present invention can be applied to a display element of electro-optical device (liquid crystal in the exemplary embodiment) having a structure similar to the described above, of which optical response time is longer than a sub-field time or almost equal to it. Such electro optical apparatus include a projector including a liquid crystal light bulb using Poly-Si TFT as a drive device, and a straight visual type liquid crystal display device using α-Si (amorphous silicon) TFT and TFD (Straight visual type LCD), for example.

Figure 17:
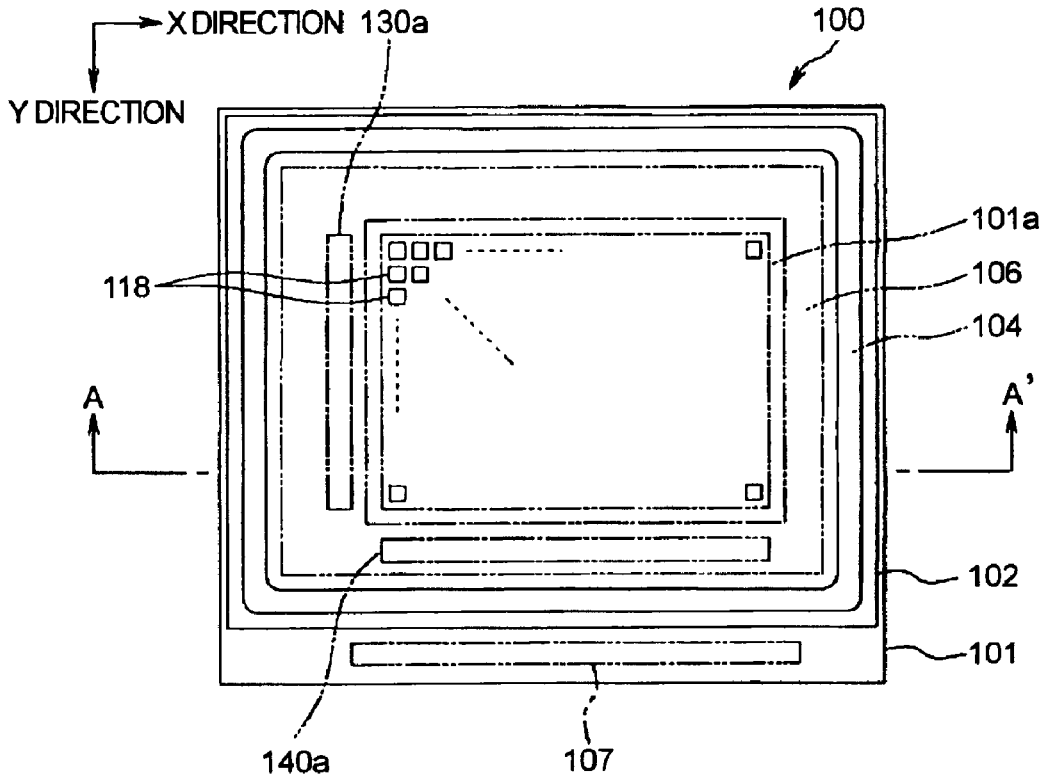
FIG. 17 is a plan view to show a structure of the electro optical device 100.
Figure 18:
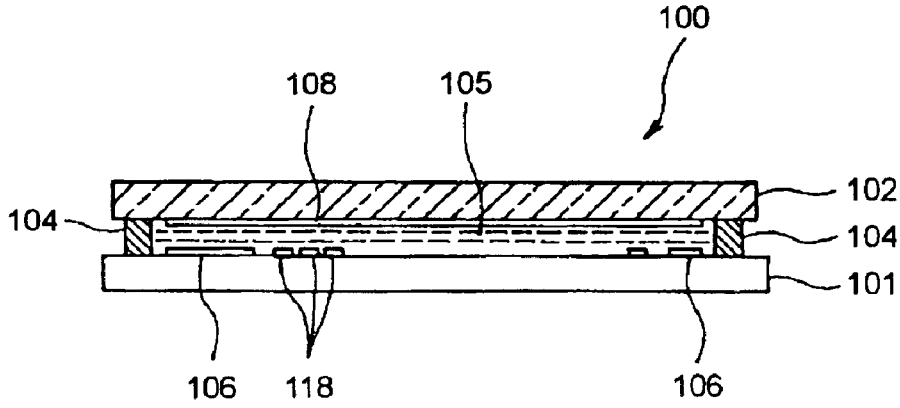
FIG. 18 is a sectional view of plane A—A in FIG. 17.

Next, the structure of an electro-optical device related to the above-mentioned exemplary embodiment and its application is explained with reference to FIG. 17 and FIG. 18. FIG. 17 is a plan view showing the structure of an electro-optical device 100, and FIG. 18 is a sectional view taken along plane A—A' in FIG. 17.

As shown in these figures, the electro-optical device 100 includes an element substrate 101, provided with the pixel electrode 118, an opposite substrate 102, provided with the opposite electrode 108, which are affixed together keeping a specific spacing with a seal material 104 and a liquid crystal 105 as electro-optical material which are sandwiched within this spacing. Here, in practice, there is a notch part in the seal material 104, liquid crystal 105 was injected via this notch and it is sealed by a sealant. But, such illustration is omitted here.

In this exemplary embodiment, the liquid crystal visual display device, having display mode of normally black, includes a liquid crystal panel provided with combining a vertical oriented layer with liquid crystal material of negative anisotropy of electric conductivity, and this panel is sandwiched between two pieces of polarized light plates of which one light transmittance axis is shifted from another axis by 90 degrees.

The TN mode type liquid crystal being normally white display mode can also be used.

The opposite substrate 102 is a transmissive substrate, such as a glass. In addition, it is described above that the element substrate 101 is a transmissive substrate. However, in case of a reflection type electro-optical device, it can be a semiconductor substrate. In this case, the pixel electrode 118 is made of reflective type metal, such as aluminum, since a semiconductor substrate is non-transmissive.

In the element substrate 101, a light shield layer 106 is arranged inside of the seal material 104 and outside of the display region 101*a*. Within the region where the light shield layer 106 is formed, the scanning driver 401 is formed in the region 130*a* and the data driver 500 is formed in the region 140*a*.

Namely, the light shield layer 106 prevents light incident onto a drive circuit formed in this region. The opposite electrode voltage VLCCOM is applied to this light shield layer 106 along with the opposite electrode 108.

In addition, in the element substrate 101, plural connecting terminals are formed in a region 107 that is located outside of the region 140*a*, where the data driver 500 is formed, and apart from the sealing material 104 so that control signals and power supply from outside are supplied thereto.

On the other hand, the opposite electrode 108 of the opposite substrate 102 is electrically conducted with the conductive terminals and the light shield layer 106 on the element substrate 101 via a conductive material (not shown in the figure) which is formed at least at one position within four corners of a portion where two substrates are affixed together. Namely, the opposite electrode voltage VLCCOM is applied to the light shield layer 106 via the connecting terminals installed on the element substrate 101 and the opposite electrode 108 via the conductive material.

In addition, in the opposite substrate 102, depending on application of the electro-optical device 100, for example, in the case of direct view type, firstly color filters arranged in a striped formation, a mosaic state or a triangular formation, are formed and secondly, light shielding layers (black matrix) made of metal material and/or resins are formed. In case of application for chromatic light modulation, for example, in case of application for a light bulb of a projector described below, color filters are not used. In addition, in case of direct view type, a light source to irradiate light from the element substrate or the opposite substrate 102 is formed in the electro optical device 100, if necessary. Further an orientation layer (not shown in the figure), processed with rubbing toward a predetermined direction, is formed between the element substrate 101 and the electrode in the opposite substrate 102 and regulates the direction of orientation of liquid crystal molecules. A polarized light element (not shown in the figure) in response to the above orientation direction is formed on the side of the opposite substrate 102. But, if polymer dispersed liquid crystal where minute grains are dispersed in high polymer is used as the liquid crystal 105, the above mentioned orientation layer and polarized light element are not necessary so that efficiency of using light is enhanced. This is advantageous to realize high brightness and saving energy consumption.

As an electro-optical material, electro luminescence element is used in addition to liquid crystal, and it can be applied to a display device by using its electro optical effect.

Namely, the present invention can be applied to all electro-optical devices having the above-mentioned structure or the similar structure, especially to electro-optical devices where gray scale is displayed by using a pixel that displays binary digits such as on and off.

Next, some examples of electronic devices using the above-mentioned liquid crystal device are explained herewith.

Figure 19:
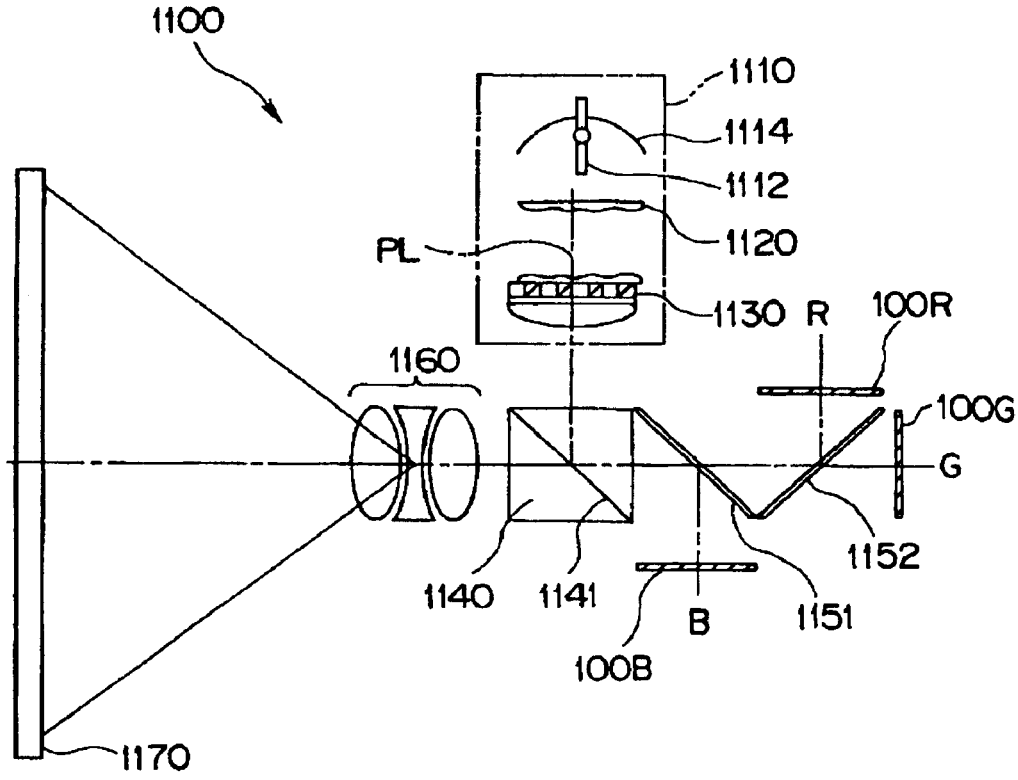
FIG. 19 is a plan view to show a structure of a projector.

Firstly, a projector where an electro-optical device related to the n exemplary embodiment is used as a light bulb is described. FIG. 19 is a plan view showing an exemplary structure of this projector. As shown in this figure, a polarized light illumination device 1110 is arranged along with a system optical axis PL in a projector 1100. In this polarized light illumination device 1110, light emitted from a lamp 1112 becomes a bundle of light rays that are generally in parallel by reflection of a reflector 1114, and are incident on a first integrator lens 1120. Hence, light emitted from the lamp 1112 is divided into plural intermediate bundles of light rays thereby. These intermediate bundles of light rays are converted into bundles of polarized light rays of one kind (bundles of S polarized light rays), of which polarized directions are generally the same, by a polarized light conversion element 1130 having a second integrator lens on the incident light side as to be emitted from the polarized light illumination device 1110.

The bundles of S polarized light rays emitted from the polarized light illumination device 1110 are reflected by a bundle of S polarized light rays reflecting surface 1141 of polarized light beam splitter 1140. Among these bundles of reflected light rays, the bundle of blue light rays (B) is reflected by a blue light reflecting layer of a dichroic mirror 1151 and modulated by a reflection type electro-optical device 100B. Further, among the bundle of light rays transmitted through the blue light reflecting layer of the dichroic mirror 1151, the bundle of red light rays (R) is reflected by the red light reflection layer of the dichroic mirror 1152 and modulated by a reflection type electro-optical device 100R.

On the other hand, among the bundle of light rays transmitted through the blue light reflecting layer of the dichroic mirror 1151, the bundle of green light rays (G) is transmitted through red light reflecting layer of the dichroic mirror 1152 and modulated by a reflection type electro-optical device 100G.

In this way, each of red, green, and blue lights that are modulated chromatically by the electro-optical devices 100R, 100G, 100B are integrated in order by the dichroic mirrors 1152, 1151 and polarized light beam splitters 1140. Then, they are projected onto a screen 1170 by a projection optical system 1160 thereafter. Here, a color filter is not necessary since the bundles of light rays corresponding to primitive color lights R, G and B are incident on the electro-optical devices 100R, 100B and 100G by the dichroic mirrors 1151, 1152.

Further, in the present exemplary embodiment, a reflection type electro-optical device is used, but a projector using a transmissive type electro-optical device may also be appropriate, for example.

Figure 20:
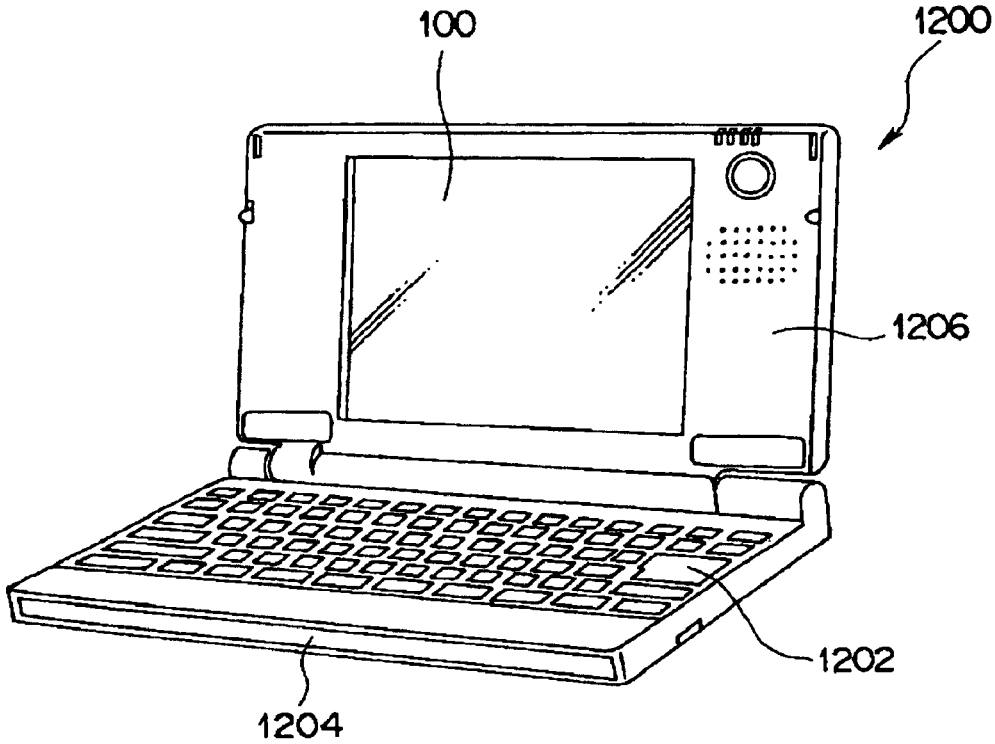
FIG. 20 is a schematic perspective view of a personal computer.

Next, an example where the above mentioned electro optical device is applied to a mobile type personal computer is described. FIG. 20 is a perspective view showing this personal computer. In this figure, a computer 1200 includes a main body portion 1204 provided with a keyboard 1202 and a display unit 1206. This display unit 1206 is provided with a front light in the front of the above-mentioned electro-optical device 100.

According to this structure, the electro-optical device 100 is used as a reflected straight view type so that unevenness is preferably formed on the pixel electrode 118 in order to scatter reflected light to various directions.

Figure 21:
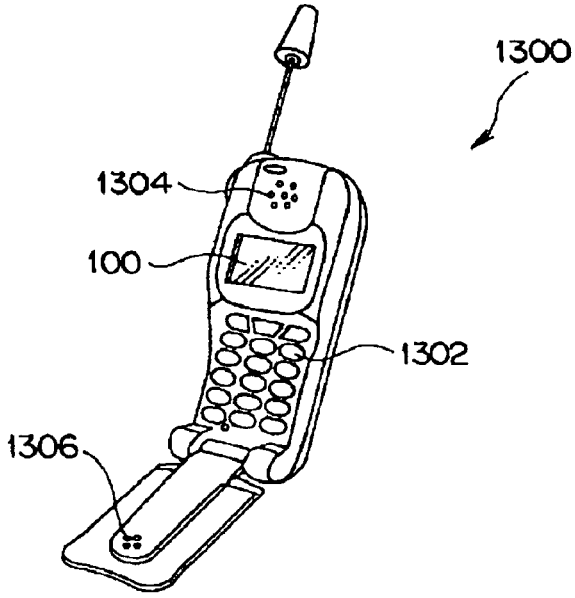
FIG. 21 is a schematic perspective view of a portable telephone.

Furthermore, an example where the electro-optical device is applied to a cellular phone is described. FIG. 21 is a perspective view that shows the cellular phone. In this figure, a cellular phone 1300 includes plural operational buttons 130, an ear piece 1304, a mouth piece 1306 and the electro-optical device 100.

In this electro-optical device 100, a front light is provided in front of it, if necessary. Further, even in this structure, the electro-optical device 100 is used as a reflective straight view type so that unevenness is preferably formed on the pixel electrode 118.

Further, various other electronic devices in addition to those described above with reference to FIG. 20 and FIG. 21, can be used, including: a liquid crystal TV, a view finder type or monitor direct-view type video tape recorder, a navigation unit for an automobile, a pager, an electronic note, an electronic calculator, a word processor, a work station, a T V telephone, POS terminals, apparatus including a touch panel, etc., for example. Further, the above-mentioned exemplary embodiments and their applications can be applied to these and other various types of electronic devices.

As discussed above, according to the present invention, it is possible to switch the mode to place emphasis on responsiveness (sight recognition of a moving image) with the mode to place emphasis on gray scale reproductiveness. Thus, reproductiveness of a moving image can be enhanced and gray scale display can be available simultaneously.

What is claimed is:

1. A drive circuit for an electro optical device that includes a display portion having pixels arranged in a matrix and electro optical material, an optical transmittance ratio of the pixels being changed by applying voltage, supplying on-voltage to make the transmittance ratio saturated, or off-voltage to make the transmittance ratio non-transmissive to the display portion, and implementing sub-field drive to realize a gray-scale in response to the ratio of an optical transmissive state to a non-transmissive state of the electro optical material per unit time and time ratio, the drive circuit comprising;

a data conversion device to place emphasis on responsiveness, the data conversion device driving each of the pixels within each sub-field, each sub-field being a control unit and formed by dividing a field into plural portions on a time axis, the data conversion device designating a sub-field for applying the off-voltage and a sub-field for applying the on-voltage in response to display data; and a data conversion device to place emphasis on gray-scale reproductiveness, the data conversion device driving each of the pixels within each sub-field, each sub-field being a control unit, the data conversion device designating a sub-field for applying the off-voltage and a sub-field for applying the on-voltage in response to the display data so that levels of gray-scale generated by the data conversion device placing emphasis on gray-scale reproductiveness are larger than levels of gray-scale generated by the data conversion device that places emphasis on responsiveness.

2. The drive circuit for an electro optical device according to claim 1, the data conversion device to place emphasis on gray-scale reproductiveness setting the time of the sub-field to be shorter than the saturation-response time so that the transmittance ratio of the electro optical material is saturated after the on voltage is applied.

3. The drive circuit for an electro optical device according to claim 1, the data conversion device to place emphasis on gray-scale reproductiveness setting the time of the sub-field to be shorter than the non-transmissive response time so that the transmittance ratio of the electro optical material is transferred from a saturated state to a non-transmissive state.

4. The drive circuit for an electro optical device according to claim 1, the data conversion device to place emphasis on gray-scale reproductiveness applying the on-voltage to the electro optical material during continuous or discontinuous sub-fields so that the integral value of the transmissive state of the electro optical material during the field period corresponds to display data.

5. The drive circuit for an electro optical device according to claim 1, the data conversion device to place emphasis on responsiveness, applying the on-voltage to the electro optical material during a sub-field period at a former end part of the field period intensively.

6. The drive circuit for an electro optical device according to claim 1, the data conversion device to place emphasis on responsiveness, applying the off-voltage to the electro optical material during a sub-field period at a latter end part of the field period intensively.

7. The drive circuit for an electro optical device according to claim 1, the data conversion device to place emphasis on responsiveness, applying the on-voltage to the electro optical material during the continuous sub-fields so that the integral value of the transmissive state of the electro optical material during the field period corresponds to display data.

8. The drive circuit for an electro optical device according to claim 1, a plurality of sub-fields within each field being set to have an almost equivalent time width.

9. An electro optical device being provided with the driving circuit of the electro optical device according to claim 1.

10. An electronic apparatus, comprising:

the electro optical device according to claim 9.

11. A drive circuit for an electro optical device that includes a display portion having pixels arranged in a matrix and electro optical material, an optical transmittance ratio of the pixels being changed by applying voltage, supplying on-voltage to make the transmittance ratio saturated, or off-voltage to make the transmittance ratio non-transmissive to the display portion and implementing sub-field drive to realize a gray-scale in response to a ratio of optical transmissive state to a non-transmissive state of the electro optical material per unit time and time ratio, the drive circuit comprising;

a data conversion device to place emphasis on responsiveness, drive each of the pixels with each sub-field as a control unit, that is formed by dividing a field into plural portions on a time axis, and designate a sub-field of applying the off-voltage and a sub-field of applying the on-voltage in response to display data;

a data conversion device to place emphasis on gray-scale reproductiveness, drive each of the pixels with the sub-field as a control unit and designate a sub-field of applying the off-voltage and a sub-field of applying the on-voltage in response to the display data so that levels of gray-scale are larger than levels of the data conversion device to place emphasis on responsiveness; and a selective device to select either the data conversion device to place emphasis on responsiveness, or the data conversion device to place emphasis on gray-scale reproductiveness.

12. The drive circuit for an electro optical device according to claim 11, the selective device selecting either the data conversion device to place emphasis on responsiveness, or the data conversion device to place emphasis on gray-scale reproductiveness in response to a user's operation.

13. The drive circuit for an electro optical device according to claim 11, the selective device selecting either the data conversion device to place emphasis on responsiveness, or the data conversion device to place emphasis on gray-scale reproductiveness based on kinds of signals of the display data.

14. The drive circuit for an electro optical device according to claim 11, the selective means selecting either the data conversion device to place emphasis on responsiveness, or the data conversion device to place emphasis on gray-scale reproductiveness in response to a state whether the display data is a moving image or a still image.

15. The drive circuit for an electro optical device according to claim 14, the selective device selecting either the data conversion device to place emphasis on responsiveness, or the data conversion device to place emphasis on gray-scale reproductiveness by determining whether the display data is a moving image or a still image every pixel.

16. The drive circuit for an electro optical device according to claim 14, the selective device selecting either the data conversion device to place emphasis on responsiveness, or the data conversion device to place emphasis on gray-scale reproductiveness by determining whether the display data is a moving image or a still image every pixel based on change of levels of gray-scale of the display data.

17. The drive circuit for an electro optical device according to claim 14, the selective device determining the different levels of gray-scale of the display data before and after one field every pixel and selects either the data conversion device to place emphasis on responsiveness when the different levels of the gray-scale are smaller or equal to predetermined reference values, or the data conversion device to place emphasis on gray-scale reproductiveness when the different levels of the gray-scale are over the predetermined reference values.

18. A method of driving an electro optical device that includes a display portion having pixels arranged in a matrix and electro optical material, an optical transmittance ratio of the pixels being changed by applying voltage, supplying on-voltage to make the transmittance ratio saturated, or off-voltage to make the transmittance ratio non-transmissive to the display portion, and implementing sub-field drive to realize a gray-scale in response to the ratio of an optical transmissive state to a non-transmissive state of the electro optical material per unit time and time ratio, the method comprising:

driving a pixel within a sub-field, the sub-field being a control unit and formed by dividing a field into a plural portions on a time axis; and selecting either a data conversion process to place emphasis on responsiveness, designating the sub-field for applying the off-voltage and the sub-field for applying the on-voltage in response to the display data, or a data conversion process to place emphasis on gray-scale reproductiveness, designating the sub-field for applying the off-voltage and the sub-field for applying the on-voltage in response to the display data so as to make the levels of gray-scale generated by the data conversion process that places emphasis on gray-scale reproductiveness larger than levels of gray-scale generated by the data conversion process that places emphasis on responsiveness.

* * * * *